US011326355B2

(12) United States Patent
Bergelin

(10) Patent No.: US 11,326,355 B2
(45) Date of Patent: May 10, 2022

(54) CONNECTING DEVICE, SUPPORT ELEMENT AND CONNECTING SYSTEM FOR BOARDS

(71) Applicant: Välinge Innovation AB, Viken (SE)

(72) Inventor: Marcus Bergelin, Lerberget (SE)

(73) Assignee: VALINGE INNOVATION AB, Viken (SE)

( * ) Notice: Subject to any disclaimer, the term of this patent is extended or adjusted under 35 U.S.C. 154(b) by 177 days.

(21) Appl. No.: 16/492,257

(22) PCT Filed: Mar. 16, 2018

(86) PCT No.: PCT/SE2018/050264

§ 371 (c)(1),
(2) Date: Sep. 9, 2019

(87) PCT Pub. No.: WO2018/169483

PCT Pub. Date: Sep. 20, 2018

(65) Prior Publication Data

US 2021/0214956 A1 Jul. 15, 2021

(30) Foreign Application Priority Data

Mar. 16, 2017 (SE) ..... 1750315-2

(51) Int. Cl.
*E04F 15/02* (2006.01)

(52) U.S. Cl.
CPC ..... *E04F 15/02044* (2013.01); *E04F 2015/02094* (2013.01); *E04F 2201/0115* (2013.01)

(58) Field of Classification Search
CPC ..... E04F 15/02044; E04F 2015/02094; E04F 2201/0115
See application file for complete search history.

(56) References Cited

U.S. PATENT DOCUMENTS 2,115,936 A 5/1938 Sterns
3,200,553 A 8/1965 Frashour et al.
(Continued)

FOREIGN PATENT DOCUMENTS

CA 2 792 923 A1 4/2013
CN 202695471 U 1/2013
(Continued)

OTHER PUBLICATIONS

Extended European Search Report issued in EP 18767988.1, dated Dec. 11, 2020, European Patent Office, Munich, DE 8 pages.
(Continued)

*Primary Examiner* — Andrew J Triggs
(74) *Attorney, Agent, or Firm* — Buchanan Ingersoll & Rooney P.C.

(57) ABSTRACT

A connecting system for boards, and a connecting device and a support element for boards are disclosed. The connecting system includes the support element configured to support at least one board and the connecting device configured to releasably fasten the at least one board to the support element. The support element includes at least one lateral surface with at least one locking member arranged on the lateral surface. The connecting device includes at least one arm with a locking member configured for engagement with the locking member of the support element. At least one of the locking member of the support element and the locking member of the connecting device includes a plurality of protrusions forming a plurality of locking positions of the connecting device relative the support element.

30 Claims, 11 Drawing Sheets

(56) References Cited

U.S. PATENT DOCUMENTS

| | | | | |
|---|---|---|---|---|
| 3,535,844 | A | 10/1970 | Glaros | |
| 3,667,180 | A | 6/1972 | Tischuk | |
| 3,998,023 | A | 12/1976 | Anderson | |
| 3,998,024 | A | 12/1976 | Frandsen | |
| 4,122,641 | A | 10/1978 | Bard | |
| 4,123,885 | A | 11/1978 | Scott | |
| 4,170,859 | A | 10/1979 | Counihan | |
| 4,184,301 | A | 1/1980 | Anderson et al. | |
| 4,187,653 | A | 2/1980 | Kliewer, Jr. | |
| 4,316,351 | A | 2/1982 | Ting | |
| 4,765,107 | A | 8/1988 | Ting | |
| 5,274,979 | A | 1/1994 | Tsai | |
| 5,277,011 | A | 1/1994 | Serrano Martin | |
| 5,394,667 | A | 3/1995 | Nystrom | |
| 6,237,295 | B1 | 5/2001 | Ballard | |
| 6,260,326 | B1 | 7/2001 | Müller-Hartburg | |
| 6,324,796 | B1 | 12/2001 | Heath | |
| 6,470,641 | B1 | 10/2002 | Faure | |
| D485,160 | S | 1/2004 | Pelc | |
| 6,857,243 | B2 | 2/2005 | Bloomfield | |
| 6,865,856 | B2 | 3/2005 | Kim et al. | |
| 7,533,500 | B2 | 5/2009 | Morton et al. | |
| 8,291,666 | B1 | 10/2012 | Garrison | |
| 8,544,229 | B2 * | 10/2013 | Kilgore | E04F 15/02044 52/489.2 |
| 8,615,958 | B2 * | 12/2013 | Kilgore | E04F 15/02044 52/650.3 |
| 8,728,609 | B2 | 5/2014 | Torres et al. | |
| 9,140,020 | B2 | 9/2015 | Torres-Pinzon | |
| 9,181,715 | B2 | 11/2015 | Orchard | |
| 9,376,822 | B2 | 6/2016 | Hannig | |
| 9,422,728 | B2 * | 8/2016 | Gamble | F16B 5/02 |
| 9,850,667 | B2 * | 12/2017 | Engstrom | E04F 15/02044 |
| 10,174,496 | B2 * | 1/2019 | Bertato | E04F 15/02044 |
| 11,149,444 | B2 | 10/2021 | Bergelin et al. | |
| 2001/0027829 | A1 | 10/2001 | Crout | |
| 2002/0095897 | A1 | 7/2002 | Summerford | |
| 2006/0283126 | A1 | 12/2006 | Juan Puerta | |
| 2007/0066096 | A1 | 3/2007 | Gillis et al. | |
| 2007/0234670 | A1 | 10/2007 | Martel | |
| 2010/0205895 | A1 | 8/2010 | Orchard | |
| 2011/0067335 | A1 | 3/2011 | Gibson et al. | |
| 2012/0110944 | A1 | 5/2012 | Hess | |
| 2013/0025228 | A1 * | 1/2013 | Kilgore | E04F 15/04 52/578 |
| 2013/0025230 | A1 * | 1/2013 | Turner | E04F 15/02183 52/586.1 |
| 2013/0104493 | A1 | 5/2013 | Orchard | |
| 2014/0165491 | A1 | 6/2014 | Lachevrotiere et al. | |
| 2014/0260041 | A1 | 9/2014 | Peck et al. | |
| 2014/0260043 | A1 | 9/2014 | Cottier | |
| 2015/0047278 | A1 | 2/2015 | Blount | |
| 2015/0176289 | A1 | 6/2015 | Hannig | |
| 2015/0368911 | A1 | 12/2015 | Kuijper | |
| 2016/0168867 | A1 | 6/2016 | Chester | |
| 2016/0233820 | A1 | 8/2016 | Redel | |
| 2017/0037643 | A1 | 2/2017 | Mitchell | |
| 2017/0044776 | A1 | 2/2017 | Rodriguez Lopez | |
| 2017/0058534 | A1 | 3/2017 | Engström | |
| 2017/0314278 | A1 | 11/2017 | Lee et al. | |
| 2019/0309527 | A1 | 10/2019 | Bergelin et al. | |
| 2019/0383026 | A1 * | 12/2019 | Bergelin | E04F 15/02016 |
| 2020/0217084 | A1 | 7/2020 | Ylikangas | |

FOREIGN PATENT DOCUMENTS

| | | | |
|---|---|---|---|
| CN | 104775595 | A | 7/2015 |
| CN | 104831903 | A | 8/2015 |
| CN | 104947907 | A | 9/2015 |
| CN | 105281645 | A | 1/2016 |
| DE | 100 64 587 | A1 | 7/2002 |
| DE | 20 2007 002 282 | U1 | 6/2008 |
| DE | 20 2009 007 507 | U1 | 9/2009 |
| DE | 10 2008 051 441 | A1 | 3/2010 |
| DE | 20 2010 004 268 | U1 | 7/2010 |
| DE | 10 2009 031 825 | A1 | 1/2011 |
| DE | 20 2011 107 843 | U1 | 11/2011 |
| DE | 20 2011 106 654 | U1 | 4/2012 |
| DE | 10 2013 109 845 | | 3/2015 |
| DE | 10 2014 115 257 | A1 | 4/2016 |
| DE | 20 2016 001 234 | U1 | 6/2016 |
| EP | 1 106 842 | A1 | 6/2001 |
| EP | 1 567 731 | B1 | 3/2007 |
| EP | 2 096 232 | A1 | 9/2009 |
| EP | 2 711 481 | A1 | 3/2014 |
| EP | 2 816 172 | A2 | 12/2014 |
| EP | 2 899 330 | A1 | 7/2015 |
| EP | 3 090 850 | A1 | 11/2016 |
| EP | 3 112 551 | A1 | 1/2017 |
| EP | 3 112 554 | A1 | 1/2017 |
| FR | 2 843 414 | | 2/2004 |
| FR | 2 914 670 | A1 | 10/2008 |
| FR | 3032739 | A1 | 8/2016 |
| JP | 2008-031827 | A | 2/2008 |
| JP | 2010-242365 | A | 10/2010 |
| JP | 2011-069155 | A | 4/2011 |
| JP | 5313012 | B2 | 10/2013 |
| JP | 2014-214498 | A | 11/2014 |
| KR | 2009-0117287 | A | 11/2009 |
| KR | 10-0944453 | B1 | 3/2010 |
| KR | 10-1042682 | B1 | 6/2011 |
| KR | 2012-0032096 | A | 4/2012 |
| KR | 2013-0056702 | A | 5/2013 |
| KR | 2016-0025167 | A | 3/2016 |
| WO | WO 2014/179838 | A1 | 11/2014 |
| WO | WO 2015/159136 | A1 | 10/2015 |
| WO | WO 2015/174835 | A1 | 11/2015 |
| WO | WO 2018/169483 | A1 | 9/2018 |

OTHER PUBLICATIONS

U.S. Appl. No. 16/467,062, Marcus Bergelin and Nils-Erik Engström, filed Jun. 6, 2019.

U.S. Appl. No. 16/720,752, Roger Ylikangas, Marcus Bergelin, Anders Nilsson Karl Quist and Caroline Landgård, filed Dec. 19, 2019.

U.S. Appl. No. 16/720,752, Ylikangas, et al.

International Search Report and Written Opinion issued in PCT/SE2018/050264, dated Jun. 18, 2018, Patent-och registreringsverket, Stockholm, SE, 14 pages.

Ylikangas, Roger, et al., U.S. Appl. No. 16/720,752 entitled "Flooring System Provided with a Connecting System and an Associated Connecting Device," filed Dec. 19, 2019.

U.S. Appl. No. 17/407,674, Marcus Bergelin and Nils-Erik Engström, filed Aug. 20, 2021.

Bergelin, Marcus, et al., U.S. Appl. No. 17/407,674 entitled "Set of Decking Boards Provided with a Connecting System," filed Aug. 20, 2021.

* cited by examiner

CONNECTING DEVICE, SUPPORT ELEMENT AND CONNECTING SYSTEM FOR BOARDS

FIELD OF THE INVENTION

The present invention provides aspects of a connecting device for a board system, of a support element for such a system, of a board connecting system, and methods to install and replace boards in such system. The connecting device and the support element may be locked relative each other in at least one direction, such that boards may be locked relative the connecting device. The connecting device and/or the board may be moveable relative the support element in the longitudinal direction of the board. The boards may be boards for decking, cladding, or roofing.

BACKGROUND OF THE INVENTION

Systems for connecting a plurality of boards or panels to an underlying surface comprise decking systems. In decking systems, locking of decking boards to an underlying support element is more frequently provided by a clip, which is also referred to as a connecting device, that holds the decking boards while it is screwed to the support element. The clip may have wings that engage opposing grooves of two decking boards. The screw may be inserted between the wings and engage the support element to lock the clip and decking boards vertically. This solution is fairly time consuming and expensive, since a screw has to be used for each clip. An example of such a system is disclosed in U.S. Pat. No. 8,291,666.

In other decking systems, a clip is designed to engage a special purpose support element or joist. The clip and support element are designed for snap fit engagement for holding the clip and the decking board in the vertical direction relative the support element. However, the support element of such systems is many times fairly weak and not self-supporting. Furthermore, the clip does not engage the decking boards in the horizontal plane, i.e. the plane of the extension of the decking boards. Such systems are for example disclosed in DE202010004268, DE202007002282, DE202009007507, and WO2015174835.

Decking is exposed to the open environment and other environmental effects. The decking boards may be made of a plastic or composite material, or be made of wood. When exposed to environmental effects, such as moisture content, temperature change, sun exposure, etc., plastic or composite decking boards move mainly in the longitudinal direction, whereas wooden decking boards move mainly in the transversal direction. This has the consequence that plastic or composite decking boards should preferably be allowed to move in their longitudinal direction, while they are locked in their transversal direction.

Furthermore, the support elements may not be entirely in a single plane, i.e. they are not level. This may make it difficult to engage a snap fit or twist fit type of clip, i.e. a screwless clip, to a support element that is located between two other support elements if the support element in-between is not supporting the decking boards while the two other support elements support the decking boards. In some situations, the clip may even brake, which may not happen during installation but at a later stage when exposed to load.

Decking boards may be damaged by wear on the top surface. With existing solutions, damaged decking boards can be replaced. Replacing a decking board in a decking connected with any type of clip can be challenging, particularly in situations where the clip is, at least partially, covered by a lip of the decking board. When the clip is covered, it may not be possible to access a screw or other member that needs to be release before the decking board can be replaced. Such a system is e.g. disclosed in U.S. Pat. No. 8,544,229. In order to take up a single decking board in an entire decking when the clip is covered, the clip may have to be broken before, or is broken during, take up. In some situations, even the decking board may have to be broken in order to take it up. This may even damage the underlying support element, which is more difficult if not impossible to replace without taking up the entire or a substantial part of the decking. If a replacement decking board cannot be fastened with a clip, e.g. due to a damaged support element or due to geometrical restrictions preventing a clip to be entered in between the boards, it is simply screwed from the top surface. However, this may impair the visual impression of the decking board. It may also affect the movability of the decking. Replacing the clip as well as the decking board is expensive.

For non-screw clip fastening solutions, the decking boards are locked in the vertical direction and may move in the longitudinal direction, which is desired. However, existing solutions have the undesired effect that the decking boards may also move in the transversal direction, which creates uncontrolled gaps between decking boards of the decking. This is solved by simply screwing some of the decking boards directly to the underlying support without using a clip, or screwing some of the clips to the underlying support. However, this counteracts positive effects of using a clip, such as easy installation and movability on the longitudinal direction.

Therefore, the present disclosure addresses a widely recognized need to provide a flexible system for connecting boards to an underlying surface, that is easy to install and allows for repairing damaged boards without damaging the board, the support element, or the clip and still allows for locking the boards with a stable connection to the support element.

SUMMARY OF THE INVENTION

Accordingly, embodiments preferably seek to mitigate, alleviate or eliminate one or more deficiencies, disadvantages or issues in the art, such as the above-identified, singly or in any combination by providing a system, a connecting system, a connecting device, a board unit, and/or a support element for boards, such as boards for decking, cladding, or roofing, wherein the boards may be made of such materials as plastic, plastic composite, Wood Plastic Composite (WPC), solid wood, such as softwood or hardwood, metal, such as aluminum, or other organic material, such as bamboo, e.g. stranded bamboo.

According to a first aspect, embodiments comprise a connecting system for boards, such as decking boards. The connecting system comprises a support element for supporting at least one board; and a connecting device configured to releasably fasten the at least one board to the support element. The support element comprises at least one lateral surface and at least one locking member arranged on said lateral surface. The connecting device comprises at least one arm with a locking member configured for engagement with the locking member of the support element. At least one of the locking member of the support element and the locking member of the connecting device comprises a plurality of protrusions forming a plurality of locking positions of the connecting device relative the support element, such as in the vertical direction.

Each of the locking member of the support element and the locking member of the connecting device may comprise a plurality of protrusions.

The support element may comprise two lateral surfaces. Each lateral surface may comprise one locking member. The connecting device may comprise two locking members. Each locking member of the connecting device may be arranged to face one of the locking members of the support element. At least one, in particular each, of the locking members of the support element and the locking members of the connecting device may comprise a plurality of protrusions. Furthermore, the connecting device may comprise at least two opposing arms. Each arm may comprise a locking member facing a locking member of an opposing arm. The lateral surfaces may be side surfaces of the support element. The locking members of the support element may be arranged on the lateral surfaces and may face in generally opposing directions.

A distance between the locking members of the opposing arms may be shorter than a distance between the locking members of the lateral surfaces. The arms may be pre-tensioned towards the support element when the connecting device is positioned in locking engagement with the support element.

The support element may comprise at least one retention element for holding a friction member configured to abut at least one board when the connecting device is positioned in locking engagement with said support element. The retention element may be provided at the top surface of the support element. The at least one retention element may be a mechanical retention element. The mechanical retention element may comprise a recess having an opening at the top surface, preferably with a cross-sectional width that is smaller than a cross-sectional width of at least a portion of the remaining portion of the recess. Alternatively, or additionally, the at least one retention element may be a chemical retention element, such as an adhesive or a tape. The top surface of the support element may preferably be arranged generally transverse to the lateral surface.

The support element may be slanted between a top surface and at least one of the lateral surfaces, such as two lateral surfaces, of said support element, or the entire top surface is slanted. The top surface may preferably be arranged generally transverse to the lateral surfaces. This may also be used for support elements having a single locking position.

A pressure plate may be provided at the connecting device. The pressure plate may be arranged generally perpendicularly to the at least one arm of the connecting device. The pressure plate may have a top surface extending at least partially over a longitudinal axis of the at least one arm. The connecting device may comprise a first and a second wing or wing section, between which the pressure plate of the connecting device may be arranged. Each wing may have a surface generally facing in a direction opposite to a top surface of the pressure plate. The pressure plate may be centered between the arms and/or the wing/wings.

The support element may comprise at least one bottom surface generally facing the opposite direction of the top surface of the support element. The bottom surface may comprise a drip edge and a support surface. A tip of the drip edge may be positioned in the same plane or substantially in the same plane as the support surface or vertically closer to a top surface of the support element than the support surface.

According to the first aspect, the support element may be provided as a stand-alone component for supporting boards. The support element may be configured to support at least one board, and may comprise at least one lateral surface, and at least one locking member arranged on the lateral surface. The locking member may comprise at least one protrusion forming at least one locking position for a connecting device of the connecting system. The locking member may comprise at a plurality of protrusions forming at least one locking position for a connecting device of the connecting system. Even if the locking member of the support element comprises a single protrusion, multiple locking positions may be provided if the connecting device comprises a plurality of protrusions. A plurality of protrusions also on the support element may provide for distribution of the locking forces, and may thus contribute to a more reliable or stable connection.

A top surface of the support element, which may be arranged generally transverse to the lateral surface, may comprise at least one mechanical retention element for holding a friction member. The at least one mechanical retention element may comprise a recess having an opening at the top surface, preferably with a cross-sectional width that is smaller than a cross-sectional width of at least a portion of the remaining portion of the recess.

According to the first aspect, the connecting device may be provided as a stand-alone component for connecting boards. The connecting device may be configured for releasably fasten at least one board to a support element of a system. The connecting device may comprise at least one arm with a locking member configured for engagement with an engagement surface of the support element. The locking member may comprise a plurality of protrusions forming a plurality of locking positions of the connecting device relative the support element.

The connecting device may comprise two locking members. Each locking member may comprise a plurality of protrusions.

The connecting device may comprise a plurality of arms. Two or more arms may be arranged in parallel, i.e. facing the same side of the support element. Each arm may comprise at least one protrusion. At least one protrusion of a first of the arms may be arranged at a first vertical position of the connecting device. At least one protrusion of a second of the arms may be arranged at a second vertical position of the connecting device. The first vertical position may be different from the second vertical position. The locking member may be formed by the at least one protrusion of the first arm and the at least one protrusion of the second arm.

The connecting device may comprise at least two opposing arms. Each of the opposing arms may comprise a locking member facing the locking member of the other opposing arm.

The connecting device may comprise a first and a second wing. The pressure plate may be arranged between the wings, such as centered between the wings. Each wing may have a surface generally facing in a direction opposite to the direction in which the top surface of the pressure plate faces.

The protrusions of the connecting device may form barbs or teeth for engagement with said at least one engagement surface of the support element. The barbs or teeth of the connecting device may penetrate into the surface of the support element. Said penetration may be obtained by pre-tension between said arms and said support. The barbs or teeth may further be aligned along one longitudinal axis of the at least one arm. They may also be transversally off-set in relation to each other along one longitudinal axis of the at least one arm. This will reduce any negative effect of a second tooth sliding in the same track caused by a first lower tooth during installation and may thereby obtain a stronger grip in the support. The support element may be made of wood, plastic or WPC (Wood Plastic Composite).

Embodiments of the various aspects disclosed provide a flexible system. Components, and elements of the components, allow for easy installation and also for repairing or replacing damaged boards. Particularly, the solutions presented allow for replacing a board without damaging the board, the support element, or the connecting device. Still, the boards are easy to install initially and provides connection to a support surface.

Embodiments of the first aspect provide for locking the connecting device in multiple positions relative the support element, such as in a vertical direction. This in turn makes the system flexible and easy to install, and may even reduce the production tolerances and requirement for leveling of the supporting surfaces before installation. It also provides a stable installation.

Embodiments of a second aspect provide for a locking and/or holding the board in a vertical as well as at least one horizontal, such as at least one transversal, direction. Hence, the system may be used with different types of boards, for example having different strength or surface characteristics, or respond differently to environmental exposure. Yet, the boards may be installed in a stable connection that may prevent the boards from separating from each other or the support. Hence, the embodiments provide for flexibility. The embodiments of the second aspect may be used without embodiments of the first aspect. However, the embodiments of the first and second aspects may be combined and contribute to a system, and components of such system, that is flexible, easy to install, and that allows for a stable installation.

Embodiments of a third aspect provide for re-installing or replacing an individual board of a plurality of boards without breaking the individual board, the support element or the connecting device. Hence, flexibility is provided for. The replacement or re-installation may be done without impairing the stability of the installation or the visual appearance. Hence, flexibility and easy installation is provided for. Hence, embodiments of the third aspect may be combined with embodiments of the first aspect and/or the second aspect.

Embodiments of a fourth aspect provide methods for easy and flexible taking up of an individual board of a plurality of boards, and re-install or replace with the same stability as when the plurality of boards was initially installed. Again, flexibility and easy installation is provided for. Hence, embodiments of the fourth aspect may be used with the system and components of any combination of the first aspect, the second aspect, and/or the third aspect.

Embodiments of a fifth aspect provide for a multi-member connecting device, wherein a first member may be disassembled from a second member. This is useful in embodiments wherein a locking member of the connecting device is non-releasable when engaging the support element. Yet, the connecting device provides a strong connection between the connecting device and the support element. Again, flexibility and easy installation is provided for. Hence, embodiments of the fifth aspect may be used with the system and components of any combination of the first aspect, the second aspect, the third aspect, and/or the fourth aspect.

Embodiments of a sixth aspect provide a system and a method for multiple support elements that may be utilized together with connecting devices having a single and/or multiple positions relative the support elements. Again, flexibility and easy installation is provided for. Hence, embodiments of the sixth aspect may be used with the system and components of any combination of the first aspect, the second aspect, the third aspect, the fourth aspect, and/or the methods of the fifth aspect.

Embodiments of a seventh aspect provide a board unit, comprising a board and a connecting device configured to releasably fasten the board to a support element. The connecting device is configured to be provided in a groove and to be secured to the board in each of an outward transversal direction of the board, a first angular direction and an opposite second angular direction. Thereby, the connecting device may be kept in position during handling of the board unit and installation of the boards may be simplified. Hence, embodiments of the seventh aspect, especially embodiments of the connecting device, the board and the support elements, may be used with the system and components of any combination of the first aspect, the second aspect, the third aspect, the fourth aspect, the fifth aspect and/or the sixth aspect.

Embodiments of an eighth aspect provide a connecting system for boards, comprising a support element for supporting at least one board and a connecting device configured to releasably fasten the at least one board to the support element. Arms of the connecting device are pre-tensioned towards the support element. Thereby, the arms may compensate for dimensional deviations in the support element which may be present during installation or which may arise over time when the support element may change shapes, e.g. due to shrinkage or deformation. Hence, embodiments of the eighth aspect, especially embodiments of the connecting device, the boards and the support element, may be used with the system and components of any combination of the first aspect, the second aspect, the third aspect, the fourth aspect, the fifth aspect, the sixth aspect and/or the seventh aspect.

Embodiments of a ninth aspect provide a decking system comprising a plurality of connecting devices, a plurality of decking boards, and a plurality of support elements, wherein the connecting devices and support elements are configured so that the boards are displaceable, preferably commonly displaceable as a single unit, along a longitudinal direction of the support elements. When commonly displaceable, gaps between the boards along this longitudinal direction may not become arbitrarily large, at least since the connecting devices interconnect the boards. Hence, embodiments of the ninth aspect, especially embodiments of the connecting device, the boards and the support element, may be used with the system and components of any combination of the first aspect, the second aspect, the third aspect, the fourth aspect, the fifth aspect, the sixth aspect, the seventh aspect and/or the eighth aspect.

Further benefits of embodiments disclosed herein follow in the detailed description.

The term "comprises/comprising" when used in this specification is taken to specify the presence of stated features, integers, steps or components but does not preclude the presence or addition of one or more other features, integers, steps, components or groups thereof.

BRIEF DESCRIPTION OF THE DRAWINGS

These and other aspects, features and advantages of which embodiments of the invention are capable of, will be apparent and elucidated from the following description of embodiments of the present invention, reference being made to the accompanying drawings, in which.

DESCRIPTION OF EMBODIMENTS

Figure 1A:
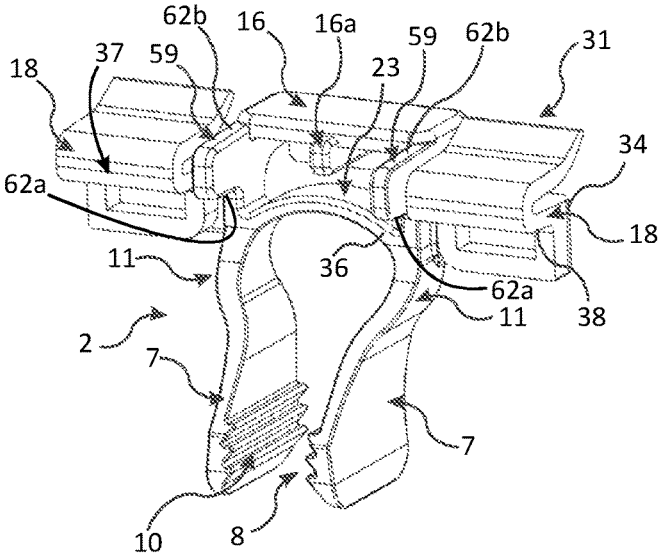
FIGS. 1*a* and 1*b* are perspective and bottom views, respectively, of the connecting device according to an embodiment.

Specific embodiments of the invention now will be described with reference to the accompanying drawings. This invention may, however, be embodied in many different forms and should not be construed as limited to the embodiments set forth herein; rather, these embodiments are provided so that this disclosure will be thorough and complete, and will fully convey the invention to those skilled in the art. The terminology used in the detailed description of the embodiments illustrated in the accompanying drawings is not intended to be limiting of the invention. In the drawings, like numbers refer to like elements.

The present invention will be described with regard to nine main embodiments referred to as "Aspects" and which are also described in "items" and the claims. Each aspect has several sub-embodiments. Furthermore, each aspect may be combined with one or several of the other aspects, including one or several of their respective sub-embodiments. Also, some general aspects are described, which are applicable to each of aspects 1 to aspect 9. In the description, reference will be made to decking, such as a decking system, a decking board, a connecting device for a decking board, and a support element for supporting a decking board. However, this is only for illustration purposes. One or a plurality of boards to be connected to a support within the context of the present invention may also comprise cladding, i.e. one or several boards or panels to be mounted on a wall, or ceiling panels, i.e. one or several boards or panels mounted to the ceiling. Whenever reference is made to a decking board in the following description, this is intended to also cover other types of boards or panels, such as cladding or ceiling panels. Hence, when reference is made to horizontal and vertical, the actual direction depends on the installation plane or installation direction. Horizontal and vertical are illustrative directions of a first direction and a second direction that are perpendicular and extend in perpendicular planes. The horizontal or first direction extends parallel to the baseline, which is the installation plane or installation direction.

Each aspect contributes to providing a system that is flexible, easy to install and allows for repairing damaged boards without damaging the board, the support element, or the connecting device and still locks the boards in at least one of their vertical direction and their transversal direction. However, each aspect may also form separate and distinct inventions. The scope of the invention is defined by the claims and items. Such benefits are useful for each of the types of boards indicted herein.

In the following description, reference will be made to horizontal, vertical, transverse, and longitudinal direction and/or plane. In the context of the embodiments described herein, horizontal, vertical, transverse, and longitudinal direction and/or plane is generally relative the installation plane or installation direction of the board, which normally is installed with its top surface in a horizontal plane. The top and bottom surfaces of the board generally extend in parallel horizontal planes. The transverse direction of the board is a horizontal direction perpendicular to the longitudinal direction of the board, and vice versa. The transverse direction is parallel to the width of the board, whereas the longitudinal direction is parallel to the length of the board. The vertical direction and/or plane is perpendicular to the horizontal direction and parallel to a normal of the top and/or bottom surfaces of the board. Axial direction in this context is the installation direction of the connecting device 2 relative the support element 1. The axial direction may be substantially perpendicular to the longitudinal direction of the support element 1. Hence one or several components of the system may extend in a direction perpendicular to the vertical direction when in an installed state, i.e. when positioned relative the board and the system is installed. Furthermore, proximal and distal end of the connecting device and elements thereof is referred to. The proximal end of the connecting device is at the end of the device for attachment to the board. The distal end of the device is at the opposite end of the device away from the attachment to the board. The distal end is the end for attachment to the support element.

Aspect 1 provides embodiments of a connecting system, a support element 1 and a connecting device 2. The connecting device may also be referred to as a clip. The embodiments are flexible and provides for easy installation. More particularly, the connecting device can be locked to the support element in multiple vertical positions. Hence, the system can absorb inaccurate leveling of support surfaces, by which boards 3 are supported. Further benefits of aspect 1 are described below.

Aspect 2 provides embodiments of a system and the connecting device 2 for the system. The embodiments are flexible and provides for easy installation. More particularly, the connecting device 2 provides for locking of the boards 3 in their vertical direction as well as holds them in a horizontal direction relative the connecting device 2. The connecting device 2 or the board 3 may lock vertically against a friction member. The connecting device may lock with a pretension, holding the board 3 firmly against the support element, e.g. against the friction member. Friction between the friction member and the board may hold or lock the board 3 in a transversal and or longitudinal direction. Further benefits of aspect 2 are described below. A combination of aspect 1 and aspect 2 provides solutions that contribute to a system that is flexible easy to install and may be locked in the vertical as well as a horizontal direction relative the connecting device 2. The connecting device 2 may be locked in the vertical direction relative the support element 1. Additionally, or alternatively, the connecting device 2 may be moveable relative the support element 1 in the longitudinal direction of the support element 1.

Aspect 3 provides embodiments of a system that is flexible and provides for easy installation. More particularly, the system comprises a connecting device 2 that provides for re-installing or replacing a single board 3 of a plurality of boards. Further benefits of aspect 3 are described below. Any combination of aspect 1 and/or aspect 2 with aspect 3 provides solutions that contribute to a system that is flexible easy to install, not only as an entirety, but also to install a single board after the initial installation, such as to replace or re-install a previously installed board of a plurality of boards.

Aspect 4 provides embodiments of methods for taking up and installing a board of a plurality of boards.

Aspect 5 provides embodiments of a multi-member connecting device.

Aspect 6 provides embodiments of a system and a method, wherein a first support element and a second support element are used together with embodiments of the connecting device, which may have a single or multiple positions relative the supporting elements.

Aspect 7 provides embodiments of a board unit 76. The embodiments provide for easy installation of the board.

Aspect 8 provides embodiments of a connecting system for boards, wherein a connecting device pretensions at least one board towards a support element.

Aspect 9 provides embodiments of a decking system, wherein a plurality of decking boards are configured to be displaceable, preferably commonly displaceable as a single unit, along a longitudinal direction of a plurality of support elements.

Regardless if the support element is configured for aspect 1, aspect 2, aspect 3, aspect 4, aspect 5, aspect 6, aspect 7, aspect 8 or aspect 9, or any other aspect or embodiment, the support element may be self-supporting, such as a joist that may carry the load applied to the boards without a continuous underlying support and have the features of the embodiments integrated therein. Alternatively, the support element is configured to be supported by a continuous support surface, such as the ground, a floor or a joist. The support element may be fastened or secured, such as screwed, to the underlying support surface or a stronger support element. The support surface may e.g. be made of concrete. The support surface may be continuous, such as a floor or the ground, a wall, or a ceiling. Alternatively, or additionally, the support surface may be dis-continuous, such as comprising a plurality of pedestals or plinths, on which the support element may be mounted, optionally with intermediate joists. Neighbouring pedestals or plinths may be separated by a distance that is larger than a distance separating neighbouring support elements.

Each aspect will now be described with reference to the drawings and by reference to a decking system. The same reference numeral is used for each aspect, which indicates that the element associated with each reference numeral may be used with any of the other elements. However, each element is not required for each aspect, but may be part of a sub-embodiment.

Aspect 1

Figure 1B:
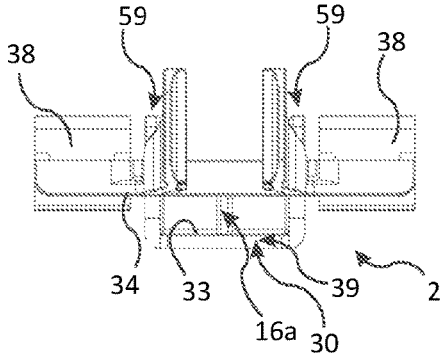
Figure 1E:
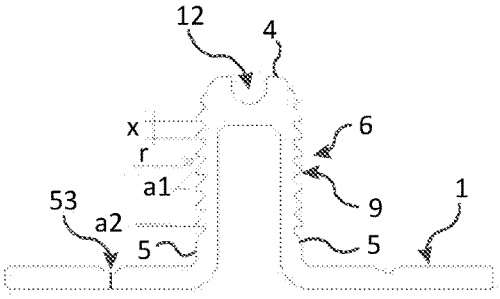
FIGS. 1*e*-1*f* are side views of embodiments of the support element.
Figure 1C:
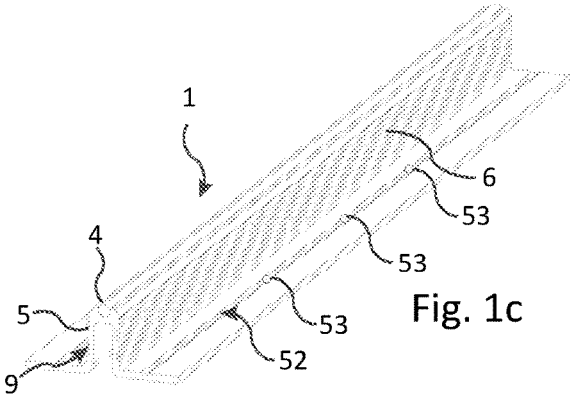
FIG. 1*c* is a perspective view of the support element according to an embodiment.

Embodiments of aspect 1 comprise a connecting system for decking, which is illustrated in FIGS. 1*a*-1*d* and 2*a*-*c*. The connecting system comprises the support element 1 for supporting at least one decking board 3, as is illustrated in FIG. 1*c*. The connecting device 2 is configured to releasably fasten the at least one decking board 3 to the support element 1. Releasably fasten in this context means that the joint between the support element and the connecting device may be disengaged by pulling the connecting device away from the support element 1 without breaking at least one of the support element 1, the connecting device 2, or the decking board 3, with or without additional need of manipulating the locking mechanism of the connecting device in a partially angled position of at least one decking board. In some embodiments, releasably fasten means that the connecting device is broken or becomes deformed when disengaged, whereas the support element and the decking board are not broken. Such a joint may e.g. be formed by a snap-fit connection. Releasably fasten also means it is not necessary to remove a screw locking the connecting device 2 to the support element 1 before separation of the two elements is possible, at least not until at least one decking board 3 has been moved out of the installed position. Hence, the connection that locks decking board 3 to the support element 1 may be screwless.

The support element 1 comprises a top surface 4 and at least one lateral surface 5. The top surface may extend generally transverse to the lateral surface. At least one locking member 6 may be arranged on the lateral surface 5.

Furthermore, the connecting device 2 comprises at least one arm 7 with a locking member 8 configured for engagement with the locking member 6 of the support element 1. At least one of the locking member 6 of the support element 1 and the locking member 8 of the connecting device 2 may comprise a plurality of protrusions 9, 10 forming a plurality of locking positions of the connecting device 2 relative the support element 1. The plurality of locking positions may be along an axial direction of the arm 7. This provides for easy installation.

Figure 3:
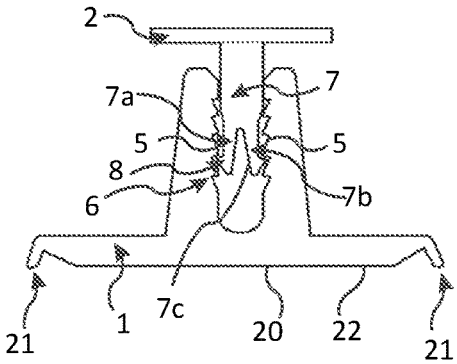
FIG. 3 is a side view of an embodiment of the connecting device locked to the support element.
Figure 4A:
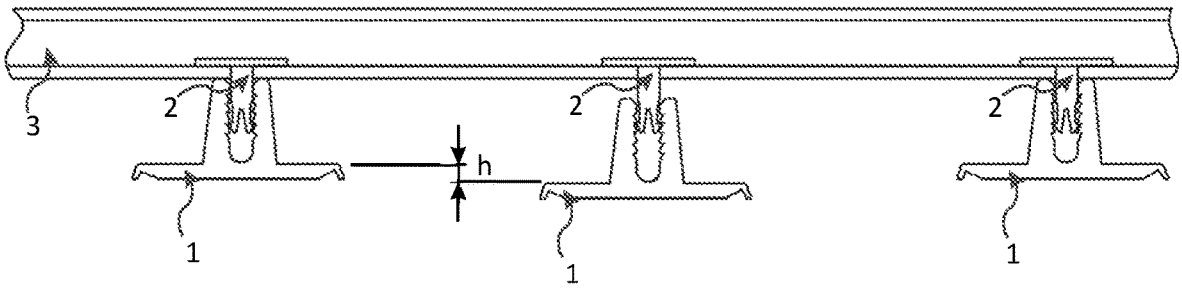
FIG. 4*a* is a side view of an embodiment of a single board with connecting devices locked in different locking positions relative support elements.

For example, and as is illustrated in FIG. 4*a*, together with FIG. 3, when a decking board 3, which generally is flat or extend in a single plane, is installed on multiple support elements 1 that are not level, the locking member 8 of the connecting device 2 may engage the locking member 6 of the support element 1 even when the decking board 3 is spaced apart from and not supported by the support element 1. As is illustrated in FIG. 4*a*, the center support element 1 is standing on a support surface that is spaced a distance h compared to the leftmost support element 1. As is illustrated in FIG. 4*a*, the decking board 3 may be supported by two support elements 1 but not one support element between the two giving support. Depending on the stiffness of the decking board, it may be difficult to bend the decking board 3 enough such that the locking member of the connecting device 8 engages the locking member 3 of the support element 1 between the two support elements 1 providing support. With multiple locking positions, initial locking may be provided before the support element 1 supports the decking board 3. As the decking board is exposed to load, such as by walking on the decking, the connecting device 2 will gradually be forced towards the support element 1 until the latter supports the decking board.

As is illustrated in FIGS. 1*a*-1*d*, each of the locking member 6 of the support element 1 and the locking member 8 of the connecting device 2 comprises a plurality of protrusions 9, 10. The protrusions may be arranged axially and be spaced apart by a valley or recess between two protrusions. A protrusion 9 of the locking member 6 of the support element 1 engages a valley or recess of the locking member 8 of the connecting device 2. The protrusions 10 and/or the arms 7 may be configured to form snap tabs, such that the connecting device 2 snaps in at least one position relative the support element 1.

In other embodiments, only one of the locking member 6 of the support element 1 and the locking member 8 of the connecting device 2 comprises a plurality of protrusions 9, 10. Still, multiple locking positions will be provided. The number of protrusions may be selected to provide a suitable locking force between the connecting device 2 and the support element 1. This in turn may be dependent on the shape of the protrusions, the size of the protrusions etc. For example, the protrusions 10 of the locking member 8 of the connecting device 2 may have a proximal flank, i.e. a side of the protrusion located towards a proximal end of the connecting device 2, which is at the decking board, and a distal flank, i.e. a side located towards a distal or free end of the connecting device 2, which is at the support element 1. The distal flank may be tilted towards or be facing the distal end, whereas the proximal flank may be tilted towards or be facing the proximal end. The protrusions of the locking member 6 of the support element 1 may have complementary flanks with shapes that are complementary to the shapes of the protrusions of the locking member 8 of the connecting device 2. The angle may also be different, e.g. a support element 1 connected to two different connecting devices 2, one with higher angle and thereby lower locking strength and one with complementary angle or over negative angle for higher strength. The level of tilt of the distal and proximal flanks impacts the force required to engage the locking member 6, 8, and the amount of force required to separate them. In general, it is preferred to have a higher angle on the distal flank of the connecting device 2 than on the proximal flank in order to obtain lower engagement force compared to the disengagement force. The protrusions may, e.g., be formed as longitudinal or extended ridges. In other embodiments, the protrusions are beads. With longitudinal ridges of the protrusions, and corresponding longitudinal valleys between ridges, the connecting device 2 may move relative the support element 1, such as in the longitudinal direction of the support element 1.

The pressure for engaging the locking member 8 of the connecting device 2 to the support element 1 may be in the range of about 20-80 N, preferably in the range of 40-50 N, per connecting device 2. The total force may be distributed between the number of locking members 6 per connecting device 2. The connecting devices 2 may be pushed down one by one, if the board is configured to allow twisting along its longitudinal direction. It can be beneficial if the decking board 3 is made less stiff by having longitudinal chambers along the length of the decking board 3 in the core. This will reduce the installation force needed. The force required for taking up or disengaging the connecting device 2 from the support element 1, i.e. the locking member 8 of the connecting device 2 from the locking member 8 of the support element 1, may be in the range of 50-1500 N per connecting device 2. The force required may be dependent on the strength of the connecting device 2. If the connecting device is made of, e.g. glass-fibre reinforced polypropylene, the force to disengage may be in the range of 80-400 N per connecting device 2 at a gap between decking boards of 3-6 mm. It is also foreseeable that the force is as high as above 700 N. A metallic connecting device 2 may obtain even greater locking strength, also in embodiments where the gap between two installed deck boards is in the range of 1-5 mm. Preferably, the force to disengage is higher than 150 N, such as higher than 400 N. Even more preferably, the force to disengage is higher than 700 N, particularly when the connecting device 2 has a first set of protrusions and a second set of protrusions, as will be described below.

As is illustrated in FIG. 1*e*, the protrusions 9 of the support element 1 may extend from the lateral surfaces 5, which may be parallel and extend in the vertical direction. The protrusions 9 may be spaced apart a distance x, such as about 1.5-3 mm, e.g. about 2 mm. The tip of each protrusion may have a radius r, which may be about 0.5-3 mm, preferably about 1 mm. The protrusions 9 may have an angle a1, which may be about 45-65 degrees, such as about 50 degrees, relative a normal of the lateral surfaces 5 and towards the top of the support element 1, i.e. the proximal flank of the protrusions of the support element 1. The distal flank may have an angle a2, which may be about 0-25 degrees, preferably 1.5-2.5 degrees, such as about 2 degrees, relative a normal of the lateral surfaces 5 and towards the top of the support element 1. In some embodiments, the angle a2 may be up to 45 degree. In some embodiments, the angle a2 is about 0 degrees or even negative, such as between −45 and 0 degrees, preferably between −25 and 0 degrees, more preferably between −10 and 0 degrees, and most preferably between −5 and 0 degrees. In such embodiments, the connecting device 2 may be designed to break or become deformed in order to disengage the connecting device 2 from the support element 1. For example, the connecting device may be designed to break by applying a large force on it, e.g.

by hitting it hard by a tool inserted between the boards. The connecting device 2 may have protrusions with complementary shapes as the protrusions of the support element 1. For example, the angle(s) of the protrusions of the support element may be complementary to the angles a1 and/or a2 of the protrusions of the connecting device. The height of the protrusions measured perpendicularly from the base of the protrusion to the tip of the protrusion may be in the range of 0.5-3 mm, such as about 0.6 mm. The width of the protrusion at the base may be about 1-10 mm. The shape of the protrusion in a cross-section taken along the vertical extension of the connecting device 2 and/or the support element 1 may be triangular. A triangular base provides for a relatively wide base, which in turn provides for strength of the protrusion, and a relatively low flank for locking for a minimal force directed upwards at taking up a decking board, i.e. disengaging the connecting device 2 from the support element 1.

Figure 1F:
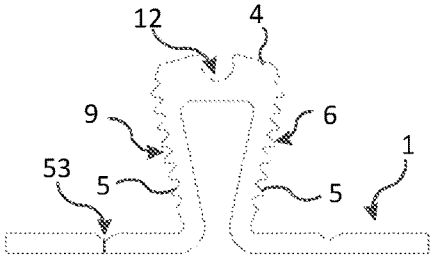
Figure 1D:
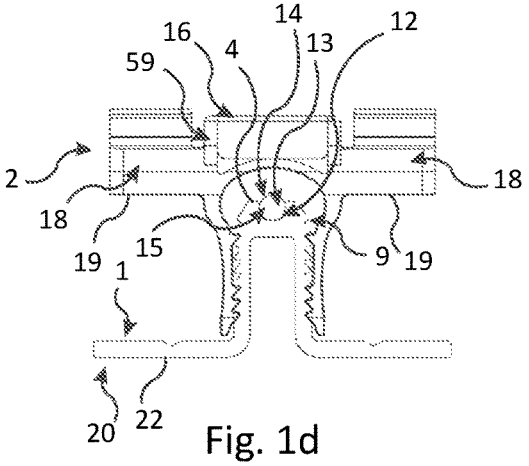
FIG. 1*d* is a side view of the connecting device in a locked position relative the support element according to an embodiment.
Figure 1G:
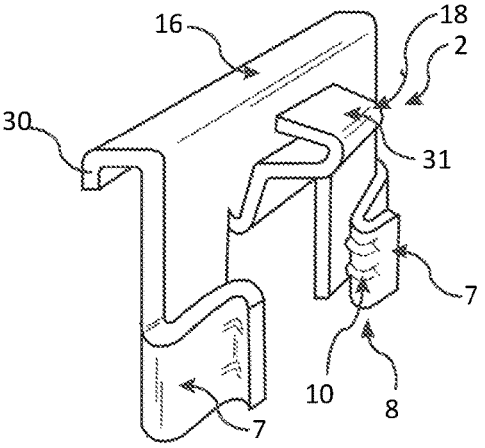
FIG. 1*g* is a side view of an embodiment of the connecting device.
Figure 1H:
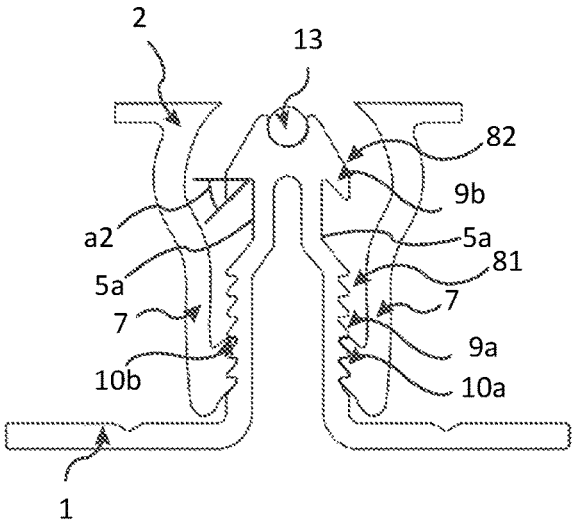
FIGS. 1*h*-1*i* are side views of embodiments of the support element and the connecting device having multiple locking members with different locking strengths.
Figure 1I:
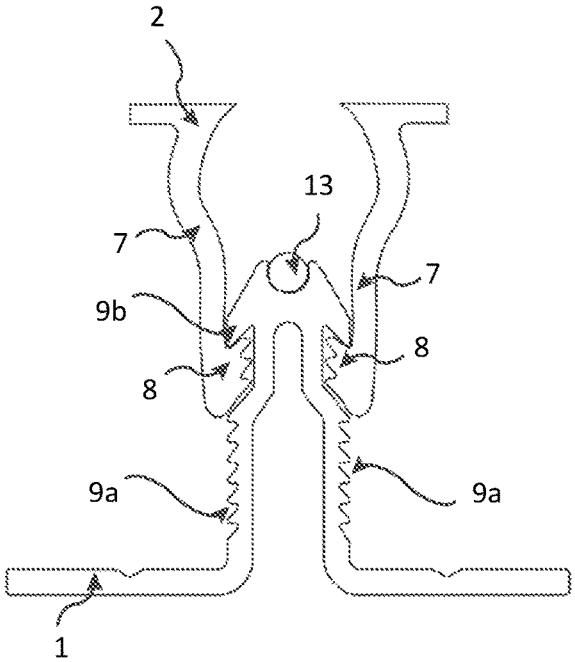
Figure 1J:
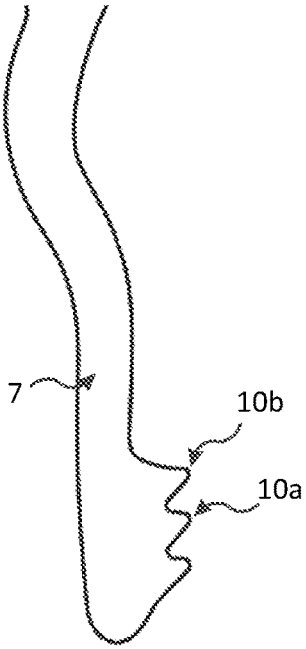
FIG. 1*j* is an enlarged side view of an embodiment of an arm of the connecting device having multiple locking members with different locking strengths.

In some embodiments, such as illustrated in FIGS. 1*h*-1*j*, the support element 1 comprises at least one first protrusion 9*a* having a first height that is different than a second height of at least one second protrusion 9*b*. Again, the heights are measured perpendicularly from the base of the protrusion to the tip of the protrusion. The first height of the first protrusion 9*a* may be lower than the second height of the second protrusion 9*b*. A plurality of protrusions 9*a* on each lateral surface 5*a* may have the first height. A single protrusion 9*b* may have the second height, such as a single protrusion on each lateral surface 5*a*, as is illustrated in FIGS. 1*h*-1*i*. Similarly, the connecting device 2 may have a first locking member with at least one first protrusion 10*a* having a height that is different, such as lower, than a second height of a second protrusion 10*b*. Alternatively or additionally, the connecting device 2 may comprise the first locking member with at least one first protrusion 10*a* extending at a first angle relative the longitudinal axis of the arm 7. The first locking member may also comprise the second protrusion 10*b* extending at a second angle relative the longitudinal axis of the arm 7. The first angle may be different than the second angle. The first angle may be less tilted relative the longitudinal axis of the arm, as measured from the tip of the arm towards the tip of the protrusion, than the second angle. This provides for a higher retention force provided by the second protrusion 10*b* than the first protrusion 10*a*. A plurality of protrusions 10*a* may have the first height and/or angle. A single protrusion 10*b* may have the second height and/or angle. Furthermore, only one of the flanks, such as the proximal flank, of the second protrusion 10*b* of the connecting device 2, need to have the second height and/or angle, as is illustrated in FIGS. 1*h*-1*j*. Hence, the support element 1 and the associated connecting device 2 comprises a first locking member and a second locking member having different locking strength in the vertical direction, which may be provided by the different heights and/or angles of the first protrusion 9*a*, and the second protrusion 9*b*, respectively.

In some embodiments, first locking member and the second locking member having different strengths may be provided on separate arms 7. Hence, one arm may have a first locking member having a first locking strength, and a second arm may have a second locking member having a second locking strength. The first locking member and the second locking member may be configured as described above with protrusions having different shapes, such as heights, and/or angles. Additionally, or alternatively, the locking strength may be provided by different materials of the locking members, wherein second locking member is made of a metallic material or reinforced by an insert of metallic material. The first locking member may be made of a weaker material and/or have a weaker configuration such that it more easily unlocks, or even breaks to unlock. This may be combined with having different heights of the protrusions 9*a*, 9*b*, 10*a*, 10*b* of the connecting device 2 and/or the support element 1. Different locking strengths may also be provided by two connecting devices. The two locking devices are configured to be mounted in pair, either separately or interconnected with each other. Hence, different locking strength is provided at substantially the same position of the decking boards 3. For example, one of the connecting devices may be made in a different material and/or having locking members with different strength than the other, as is described with regard to various embodiments herein.

In some embodiments, each lateral surface 5*a* of the support element may have a releasable first locking member 81 and a second non-releasable locking member 82, as is illustrated in FIGS. 1*h*-1*i*. This may be provided with or without the first height of the first protrusion 9*a*, and the second height of the second protrusion 9*b* described above. The non-releasable second locking member 82 may be provided by a protrusion, such as the second protrusion 9*b*, or more generally by the at least one second protrusion 9*b*, having a negative angle a2 relative a normal of the lateral surface 5*a*, which may extend in the horizontal direction as illustrated in FIG. 1*h*. The negative angle a2 provides a protrusion 9*b* that has a distal flank directed towards the lateral surface 5*a*. Hence, the protrusion of the connecting device 2 having a complementary shape, such as the second protrusion 10*b*, may not disengage from the protrusion 9*b* of the support element 1. Instead, the locking member of the connecting device needs to be broken or become deformed in order to separate the connecting device 2 from the support element 1. Again, this provides for a first and a second locking member having different strengths.

The releasable first locking member 81 may be provided by the at least one first protrusion 9*a*. In some embodiments, the first protrusion 9*a* of the support element 1 may have a distal flank with an angle a2 relative a normal of the lateral surface 5*a* that is neutral or positive, i.e. which is releasable. Hence, the connecting device 2 may be possible to partly disengage from the support element 1, such as to disengage a first decking board 3*a* as described below with regard to FIG. 6*a*, which does not need to be removed in order to remove a second decking board 3*b*. In such situations, it will only be necessary to break or deform a connecting device 2 for removing the second decking board 3*b*, but not for the first decking board 3*a*. Furthermore, the non-releasable locking member 82 provides a stronger lock in the vertical direction than the releasable locking member 81, which may prevent disengaging due to environmental effects, such as strong winds, but it is still possible to remove a decking board. The non-releasable locking member 82 may be disengaged by inserting a tool between two decking boards 3 and simply disengage, such as described below with regard to aspect 4. The non-releasable locking member 82 may also be released or disassembled, such as described with regard to aspect 5. Finally, the non-releasable locking member 82 may be released or disassembled by displacing the connecting device 2 downwards towards the support element 1, displacing the arms 7 transversely outwards and thereafter displacing the connecting device 2 vertically upwards.

It should be noticed that the second protrusion 9*b* may also have a positive angle a2, such as to fit with the second protrusion 10*b* at arm 7 illustrated in FIG. 1*j* that is only an enlargement of one leg or arm of a connecting device that may comprise two such legs or arms, as described with regard to other embodiments. The second locking member provided by protrusion 10*b* in FIG. 1*j* may be released without breaking or deforming it, but it provides a stronger locking force compared to the first locking member provided by protrusion(s) 10*a*, which has/have a lower height.

The connecting member 2 having different locking forces may be provided together with connecting devices only having a single locking force relative the support element 1. For example, it may be desired to lock some of the decking boards in a decking with a stronger locking force than other decking boards, such as every 3-5 decking board in order to lock the entire decking and prevent unlocking in the vertical direction due to environmental effects.

In some embodiments, such as is illustrated in FIG. 1*f*, the lateral surfaces 5 are non-parallel and are closer together at their base than at the top end of the support element 1. The angle between the lateral surfaces at the base may be about 40-80 degrees, such as about 45 degrees. The arms 7 of the connecting device 2 may be angled similarly as the lateral surfaces, and be spaced apart less at their free ends and be increasingly spaced apart towards the proximal end of the connecting device 2. The protrusions of the connecting device 2 may engage each protrusions of the support element as they slide down towards the base of the supporting element 1. The flanks may replace the individual protrusions and may consequently be planar.

Furthermore, the flanks of the protrusions 9, 10 of the connecting device 2 or the support element 1 may have friction enhancing elements, such as small retention grooves, rough surface or barbs.

The connecting device 2 may be made of a plastic having an E-modulus of about 5-9 GPa, preferably glass fiber reinforced and preferably with long glass fibers. It may be made of Polypropylene. However, the E-modulus may be lower, such as if made with Polyoxymethylene (POM) or Polyamide (PA).

In some embodiments, each arm of the connecting device 2 comprises a locking member 8. Each locking member may comprise at least one set of protrusions 10. Each set may comprise one or a plurality of protrusions.

Figure 4B:
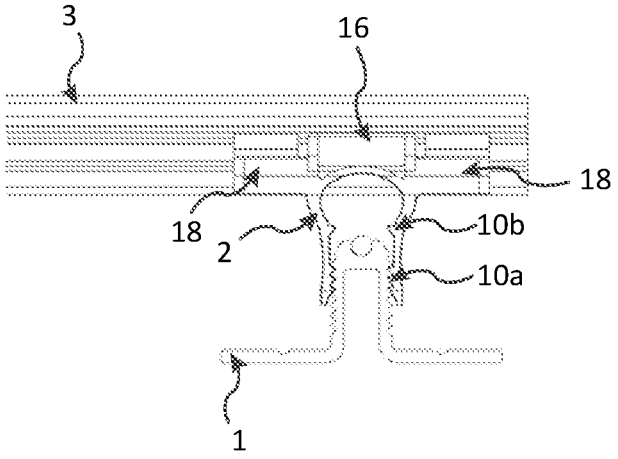
FIGS. 4*b*-4*d* are side views of an embodiment of a connecting device locked in different positions relative the support element.
Figure 4C:
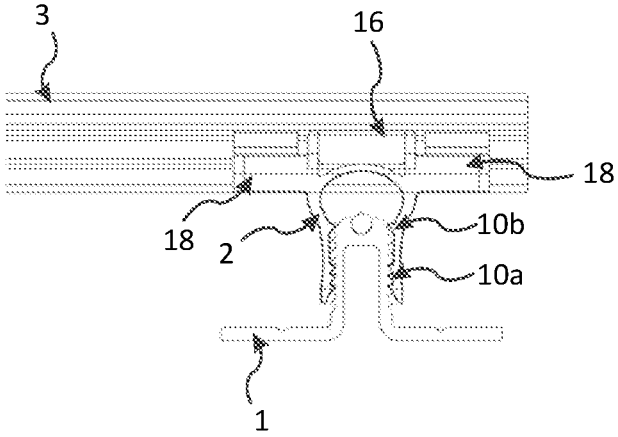
Figure 4D:
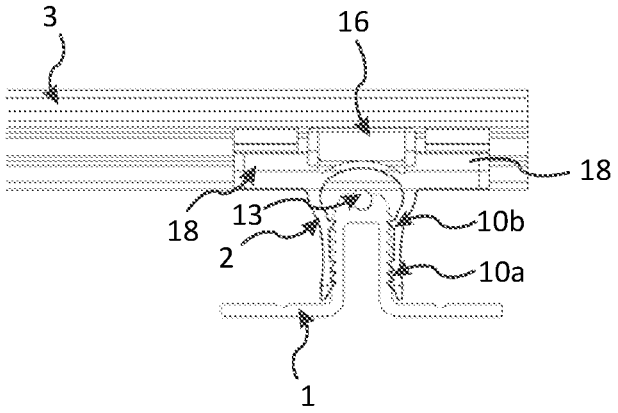

In some embodiments, such as is illustrated in FIGS. 1*d* and 4*b*-4*d*, a first set of protrusions 10*a* are provided at the free or distal end of the arms 7. Additionally, or alternatively, a second set of protrusions 10*b* may be provided at the proximal end, i.e. closer to the decking board 3 when installed, than the first set of protrusions. In the illustrated embodiment, one protrusion is provided at the proximal end, and a plurality of protrusions is provided at the distal end. The first set of protrusions 10*a* and the second set of protrusions 10*b* may be spaced apart by a section without any protrusions, such as is illustrated. The support element 1 may have a first and/or a second set of protrusions arranged to mate with the valley or recess between the protrusions of the first and/or second set of protrusions of the connecting device 2. Providing a second set of protrusions provides for preventing tilting of the connecting device 2 and thus a stable installation when the connecting device is fully seated relative the support element 1, such as is illustrated in FIG. 4*d*. Tilting of the connecting device 2 may occur when the decking board 3 moves in the longitudinal direction, such after being exposed to environmental effects. Tilting of the connecting device may ultimately disengage the connecting device 2 and the support element 1. The first set of protrusions provides for easy installation by early connection of the connecting device to the support element, i.e. even before the decking board is not fully supported by the support element as is illustrated in FIGS. 4*b* and 4*c*, as well as a stable connection when the decking board is fully supported, as is illustrated in FIG. 4*d*. The second set of protrusions may contribute to the stability of the connection over time. Hence, the flexibility of the system is also improved.

In some embodiments, each arm of the connecting device 2 comprises at least one protrusion. The peak or tip of each protrusion of each arm may be provided in different planes compared to an opposing peak or tip of the other arm, such as different horizontal planes relative the decking board 3 when installed. Hence, a peak of a protrusion of a first arm 7 may be offset in the axial direction relative a peak of a protrusion of a second arm 7. Hence, as the connecting device 2 is pushed over the support element 1, the protrusions on each arm will alternatingly engage an opposing recess or valley of the support element. When the protrusions 10 of one arm 7 mates with a recess or valley of the support element 1, the protrusions 10 of the other arm 7 will be positioned against the peak or tip of the protrusion of the other side of the support element. This provides for improved resolution or number of possible positions for the arm relative the support element. Alternatively, the protrusions of each arm can be spaced a larger distance with maintained resolution, whereby the strength of the connecting device may be improved.

In other embodiments, the connecting device 2 comprises a plurality of arms on each side of the clip or on each side of the support element. For example, a pair of arms on one side may face a pair of arms of the other side. This may be combined with the peak or tip of the protrusions being arranged in different planes as described above. For example, one arm on each side of the connecting device, i.e. two arms facing in opposing directions, may have protrusions arranged in the same, first plane, whereas two of the other arms on each side facing in opposing directions may have may the protrusions arranged in the same, second place. This provides for an even distribution of forces, such as when the connecting device 2 is attached to the support element 1.

Furthermore, in some embodiments when the connecting device 2 is in one of its locked positions relative the support element, the proximal flank or side of the protrusion of the connecting device 2 abuts the distal flank or side of the support element 1. However, the distal flank or side of the protrusion of the connecting device 2 may be spaced apart from the proximal flank or side of the support element 1. This may prevent undesired wear and noise due to these sides rubbing against each other. Furthermore, if the protrusions are elongated, they may prevent tilting of the connecting device 2 relative the support element 1, since at least the proximal flank of the connecting device and the distal flank of the support element abut along at least a portion of the elongated protrusion.

As is illustrated in FIGS. 1*c*-1*d* and FIG. 3, the support element 1 may comprise two lateral surfaces 5. In the embodiment of FIG. 1*c*-1*d*, the lateral surfaces are external surfaces of the support element. In the embodiment of FIG. 3, the lateral surfaces 5 are provided in a recess of the support element 1, which extends from the top surface 4 of the support element.

The embodiment of FIG. 3 only requires a single arm 7. However, it may comprise at least two arm portions 7*a*, 7*b* as is illustrated in FIG. 3. The arm portions 7*a*, 7*b* may be provided by a slit 7*c* extending from the distal end of the arm 7 towards the proximal end. The slit 7*c* may split the arm 7 in a first arm portion 7*a* and a second arm portion 7*a* at the distal end such that the arm portions 7*a*, 7*b* flex in the lateral direction and the locking member 6 of the support element 1 may engage the locking member 8 of the connecting device 2. The locking member 8 of the connecting device 2 may be provided at at least one of the arm portions 7*a*, 7*b*.

Each lateral surface 5 may comprise one locking member 6. The connecting device 2 may comprise two locking members 8. Each locking member 8 of the connecting device 2 may be arranged to face one of the locking members 6 of the support element 1. At least one of the locking members 6 of the support element 1 and the locking members 6 of the connecting device 2 comprises a plurality of protrusions 9, 10. In the embodiments illustrated in FIG. 3 and FIG. 4*a*, a locking member 6 is provided on each lateral surface 5. However, a single locking member 6 on a single lateral surface 5, and thus single locking member 8 on the connecting device 2, is also envisaged.

In the embodiments illustrated in FIGS. 1*a*-1*d*, FIGS. 2*a*-*c*, and FIGS. 4*b*-4*d*, the connecting device 2 comprises two opposing arms 7. Each arm may comprise a locking member 8 facing the locking member 8 of the other arm 7. The lateral surfaces 5 of the support element 1 may be side surfaces of the support element 1. The locking members 6 of the support element 1 may be arranged on the lateral and/or side surfaces and may be facing in generally opposing directions. When the decking is installed and the connecting device 2 is locked to the support element 1, the lateral surfaces 5 of the support element 1 extend between the arms. The arms 7 are spaced apart such that the locking member 6 of the support element 1 engages the locking member 8 of the connecting device 2. At the proximal end 11 of the arms, they may be spaced a distance that is larger than at the opposing distal or free end of the arms 7. For example, the arms may be arced at the proximal end.

The proximal end 11 of the arms 7 may be connected by a bridge member 23, which may be formed by the arched end of the arms 7. In the illustrated embodiment in FIGS. 1*a*-1*b*, FIG. 1*d*, and FIGS. 4*b*-4*c*, the bridge member 23 is arced. In other embodiments, it may be substantially straight. Furthermore, there may be provided a bridge member between at least one of the wings 18 and at least one of the arms 7. The bridge member 23 between the wing and the arm may extend from the wing and be connected at a distal end portion of the arm 7 and extend towards a proximal end portion of the arm 7, such as to about half the length of the arm. This bridge member may increase the spring constant of the arms 7.

Clearly, the bridge member is optional, and according to other embodiments (not shown), the connecting device does not comprise a bridge member. For example, the arms 7 may be connected by the pressure plate 16 only.

Each of the shape of the arms, such as at their proximal ends 11, and the shape of the bridge member 23 may contribute to the flexibility of the arms, which in turn impacts the locking force between the elements. The distal or free ends of the arms 7 may be spaced apart about 5-100 mm, preferably about 10-20 mm, such as about 12-14 mm. The lateral side of the support element 1 may be spaced apart a corresponding distance. From the distal or free ends of the arms 7 and towards the opposing proximal ends, the distance between the arms 7 may narrowing, such as about 1-3 mm, before the being spaced apart a constant distance. The constant distance may be about 9-15 mm, such as about 10-12 mm. This provides for installation tolerances, since the outwardly flaring of the arms 7 at their distal ends allows for a slight misalignment over the support element 1, which is useful during replacement of a decking board 3. As the decking board 3 is tilted towards the support element 1, the arms 7 will align the connecting device 2 relative the support element 1. Hence, flexibility is provided for. For example, a difference of 2.5 mm between the distance at the distal end compared to the constant distance allows for a misalignment of 1.25 mm on each side of the support element 1.

At the proximal end of the arms, i.e. the end of the arms opposing the distal end, the arms 7 may be spaced apart slightly more, preferably about 0.5-3 mm, such as about 1 mm, than the maximum transversal distance between protrusions on either side of the support element 1. This allows for installation tolerances and allows the connecting device 2 to tilt slightly. However, even if it tilts, it will ultimately be supported by the support element 1, but it will not jam during take up of a decking board. The proximal portion, such as the proximal 50-75% of the arms, may be substantially flat at the surfaces facing the support element 1, whereby the connecting device 2 does not engage the support element at this section of the arms 7. This assists in preventing tilting of the connecting device 2 as the decking board 3 is exposed to environmental effects. In some embodiments, the distance between the locking members 8 of the connecting device, such as at the distal end of the arms 7, is shorter than a distance between the locking members 6 of the opposing side of the support element 1, such as at the lateral surfaces 5. In such configurations, the arms 7 are pre-tensioned towards the support element 1 when the connecting device 2 is positioned in locking engagement with the support element 1. This may impact the force required to separate the elements. However, it also provides for a tight fit even with more relaxed production tolerances compared to when no pre-tension is provided. This in turn contributes to lower production cost of the system. For example, the difference in distance between opposing protrusions of the arms 7 and the distance measured perpendicularly between protrusions on either side of the support element 1 may be about 1-3 mm, which means that each arm may flex outwardly about 0.5-1.5 mm as the connecting device 2 is positioned in a locked position relative the support element 1. Pre-tensioning of the arms 7 towards the support element 1 may also be provided in embodiments where a single locking position between the connecting device 2 and the support element 1 is provided.

Figure 5A:
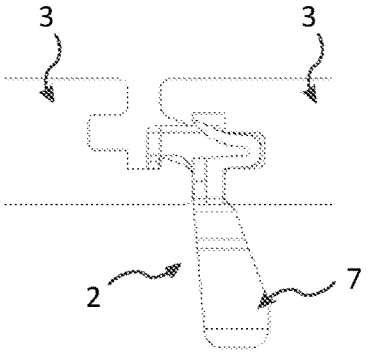
FIGS. 5*a* and 5*b* are side views of embodiments of the connecting device with arms having different sizes and area of the locking members for engagement with the support element.
Figure 5B:
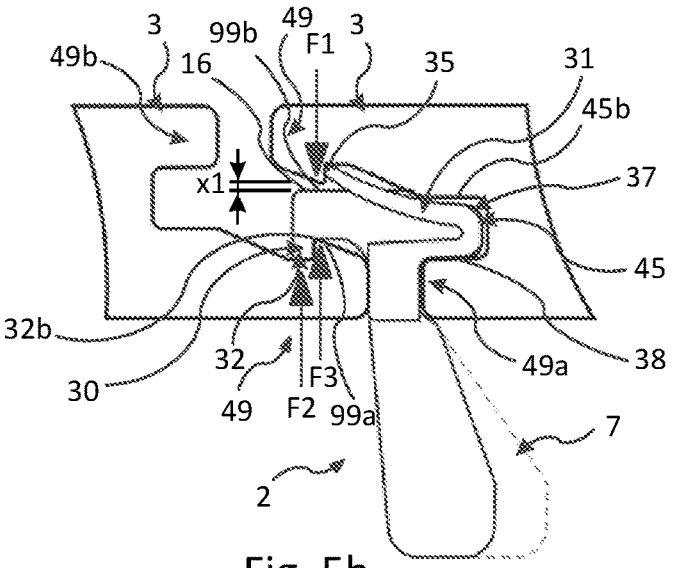

As is illustrated in the embodiment in FIGS. 5*a*-5*b*, the width of the arms in the longitudinal direction of the support element 1 may be larger at the distal or free end of the arms compared to the proximal end. This provides for increased area for providing the locking members 6. The width of the arms in the longitudinal direction of the support element 1 may be slightly smaller, the same or larger than the lower gap between two neighboring decking boards 3. The bridge member 23 between the wing and the distal or free end portion of the arm 7, which is mentioned above, may be connected to the arm at an outer or outermost portion, i.e. away from a first holding member 30, of the distal end portion of the arm. This prevents twisting of the connecting device 2, particularly when it is loaded. The outermost portion of the arm 7 is illustrated to the right in FIG. 2*a* and is the widest portion of the arm 7. Prevention of twisting may also be provided by the width of the arms 7 or wings 18, or a combination thereof.

In the illustrated embodiments, the width of the arms 7 at the distal or free end is larger in the embodiment of FIG. 5*b* than in the embodiments of FIG. 5*a*, which is illustrated with phantom lines in FIG. 5*b*. Furthermore, the connecting device 2 may be configured to at least partially receive a tongue 49*a* of the decking board 3 between the arms 7 and a release surface 38. In some embodiments, a top end of the arms 7 and the release surface 38 forms a slot sized and configured to receive the tongue 49*a*. Hence, the connecting device 2 may be held by the tongue 49*a* during tilting of the decking board 3, whereby the position of the connecting device 2 relative the decking board 3 is substantially maintained during tilting. The connecting device 2 may additionally or alternatively be configured to be held between opposing surfaces of at least one groove 43, 45 of the decking board 3. For example, the connecting device 2 may be configured as a snap tab, such as will be described below.

As is also illustrated in FIG. 5*b*, the pressure plate 16 and/or other upper parts of the connecting device 2 may be sized and configured to be spaced apart from the overlapping decking board 3, such as its tongue 49, at one or several positions. A gap or distance x1 may be present between the upper parts of the connecting device 2 and the overlapping decking board 3 at one or several positions. For example, the gap x1 may be present between the tongue 49 of the decking board 3, against which a second holding member 31, such as the tip of a snap tab of the connecting device 2, may contact, and the pressure plate 16 and/or upper parts. Contact points between the connecting device 2 and the decking boards 3 may be provided at the tip or free end of the first holding member 30, such as the tip 32 of a hook, at the tip or free end of the second holding member 31, such as the first stop surface 35, and/or at a base 32*b* of the first holding member 30. The connecting device and the board may be configured such that the tongue 49, such as a portion facing the connecting device, and at least a portion of the pressure plate 16 make contact when the board is loaded, e.g. loaded above a critical weight. A contact point may also be provided at the release surface 38 when held in a third groove 45. The third groove 45 may be provided in a side surface 61 of the second board and may be provided between the tongue 49 and the tongue 49*a*, having an opening facing in the transversal direction. The contact points at the tip or free end of the first holding member 30, and/or at the base 32*b*, and at the release surface 38 may hold the decking boards 3 in the vertical direction. The base 32*b* of the first holding member 30 may form a base of the hook, which contacts the tongue 49 at point 99*a*. In case the decking boards 3 are not in contact with the support member 1, but still connected via connecting device 2, and the overlapping decking board 3 is subjected to vertical load, the gap x1 may be reduced or eliminated, whereby the load is transferred via the contact points, which may be contact point 99*b*, to the lower overlapped decking board 3. The contact points may be transversally aligned, i.e. located relatively close in the transversal direction. This may prevent undesired twisting or application of an undesired resulting force to the connecting device 2 when forces F1, F2, and/or F3 are applied at the contact points. The gap x1 allows for larger production variations of the profile geometry of the decking board 3. The gap x1 may also at some positions be negative where the connecting device 2 may flex and thereby still fit, e.g. the second holding member 31 may flex such that the contact point 35 at the tip may contact with vertical and or transversal pretension against the decking board 3.

The support element 1, such as at the top surface 4 of the support element 1, may comprise at least one retention element 12 for holding at least one friction member 13. The retention element may be a mechanical retention element. Alternatively, or additionally, the retention element may be a chemical retention element, such as an adhesive or a tape. The friction member 13 may be positioned between, such as centered therebetween, two arms 7 of the connecting device 2 when it is positioned in locking engagement with the support element 1. Hence, the arms 7 may prevent the friction member 13 to slide away should the friction member come loose. Each friction member 13 may be configured and arranged to abut at least one decking board 3 when the connecting device 2 is positioned in locking engagement with the support element 1, as is illustrated in FIG. 4*d*. The friction member 13 may be compressible, which provides for assuming any axial misalignment between the locking member 6 of the support element 1 and the locking member 8 of the connecting device 9. For example, the friction member 13 may be compressible less than the distance between two protrusions of the locking member 8 of the connecting device 2. This may provide a pretension of the protrusions of the connecting device 2, such as its proximal side, towards, e.g., the distal side of the recess or valley between protrusions of the support element. This will increase the friction between the decking board 3 and the support element 1. Hence, this provides for a tight and stable locking. Furthermore, the friction member 13 may increase the friction between the support element 1 and the decking board 3 compared to the decking board 3 being supported directly on the top surface 4. This may reduce any tendency of the decking board 3 to move in the transverse direction of the decking board 3. The friction member 13 may be made of a plastic or rubber material. For example, the friction member may comprise, or may be made of, nitrile, nitrile rubber, or ethylene propylene diene monomer, EPDM, rubber. The bottom side of the decking board will not be damaged when it is loaded. This provides for re-use the decking board 3 if the top side is damaged. The decking board can be released by disengaging the locking members 6, 8, the decking board 3 flipped around, and re-installed and again locked by the connecting device 2. If the shape of decking board in the longitudinal direction has been affected by environmental effects, such as being slightly curved due to support elements being unlevelled, the decking board 3 may be slightly curved away from the support element 1 after it has been flipped around. In such situations, multiple locking positions between the locking member 6 of the support element 1 and the locking member 8 of the connecting device 2 is useful. Furthermore, the friction member allows for movement of the decking boards 3 in their longitudinal direction while the connecting device still locks the boards in the vertical direction and holds them in the transversal direction. Furthermore, the connecting device may allow some movement in the transversal direction, which accommodates for using the connecting device with wooden decking boards that generally moves in the transversal direction rather than the vertical direction. What has been described above with regard to the support element 1 and the configuration of the top surface 4 and the retention element is applicable to any support element, i.a. also to a support element not having any locking member, or a support element having a locking member providing a single locking position of the connecting device, such as described with regard to other embodiments herein. Hence, this embodiment of aspect 1 may be used independently or in combination with other embodiments described herein, such as with regard to aspects 1 to aspect 9.

The bridge member 23 of the connecting device 2 may be spaced apart from the top surface 4 as well as the friction member 13 when the decking board 3 is supported. The distal end of the arms 7 may be spaced apart from the support element 1 when the decking board 3 is supported. This provides for avoidance of damaging the connecting device when the decking board 3 is loaded. However, in some embodiments, a portion of the connecting device 2 may engage, e.g. penetrate into the surface of the friction member 13 in order to increase the locking force against the friction member 13. For example, a nail or barb element may extend from the connecting device 2, such as from the bridge member and be configured to engage the friction member 13.

In some embodiments, the at least one retention element comprises a mechanical retention element 12 that comprises a recess 15 having an opening 14 at said top surface 4 with a cross-sectional width that is smaller than a cross-sectional width of at least a portion of the remaining portion of the recess. The friction member 13 may have a shape that is at least partially substantially complementary to the recess. Since the friction member 13 may be compressed, it may expand after being inserted into the mechanical retention element 12, and held within the recess. The mechanical retention element 12 is not impacted by environmental effects, such as rain, ice, particles, etc. that could separate the friction member 13 from the support element 1. However, in other embodiments, the friction member 13 is attached to the support element 1 by other retention elements, such as to the top surface 13, by an adhesive or a tape.

As is illustrated in FIG. 1*d* and FIGS. 4*b*-4*d*, in some embodiments the support element 1 is slanted, i.e. not parallel relative the horizontal plane of the decking, between the top surface 4 and the external lateral surfaces 5 of said support element 1. In other embodiments, the entire top surface is slanted, i.e. not parallel relative the horizontal plane of the decking, substantially from the opening 14 of the recess 15 to the lateral surface 5, such as illustrated in FIGS. 1*e*-1*f*. This provides for avoidance of water and other particles being trapped on the top surface 4 of the support element 1 and the decking board 3. Water may freeze, and particles may agglomerate, such that the decking board 3 is separated from the support element 1, and even from the friction member 13 when provided. This in turn may cause reduced friction between the decking board 3 and the support element 1, whereby the entire decking may be misaligned. Hence, the slated surfaces contributed to the stable locking of the decking boards, after being exposed to environmental effects. Also, since the effect of water and other particles being trapped on the top surface 4 of the support element 1 and the decking board 3 does not need to be accounted for, the holding force between the member 1 and the connecting device 2 can be reduced, which makes it easier to separate the components to re-install or replace a decking board 3.

In some embodiments, the connecting device 2 comprises a pressure plate 16 configured such that a pressure may be applied to the connecting device 2 in order to lock it to the support element 1. The pressure plate 16 may be arranged generally perpendicularly to the at least one arm.

Figure 2A:
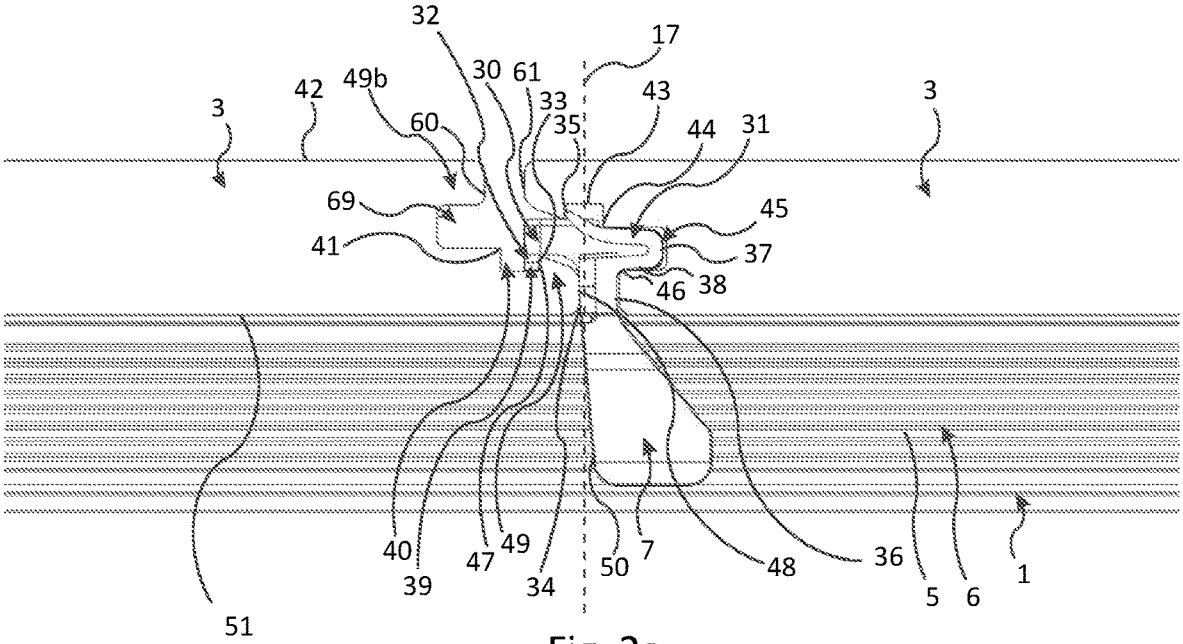
FIG. 2*a* is a side view of an embodiment of the connecting device locking boards and being locked to the support element.

As is illustrated in FIG. 2*a*, the pressure plate 16 may have a top surface extending at least partially over a longitudinal axis 17 of the at least one arm 7. Hence, a pressure may be applied along the longitudinal axis 17. The pressure plate 16 may even extend over a longitudinal axis 17 centered horizontally in the middle of the protrusions 10 in order to align the pressure force with the counter force from the protrusions 10. This provides for easy installation of the connecting device in order to lock the connecting device 2 to the support element 1.

As is illustrated in FIGS. 4*c*-4*d* the connecting device 2 may be centered relative the friction member 13. For example, the center of the pressure plate 16 may be centered over the friction member 13. An alignment element 16*a*, illustrated in FIGS. 1*a*-1*b*, may be located in the center of the pressure plate 16. When attaching the connecting device 2 to a decking board that has been taken up, the alignment element 16*a* may be centered over the friction member 13 by using the alignment element 16*a* as a visual center reference. The alignment element may be provided at the underside of the pressure plate 16. The alignment element may e.g. prevent that tilting of the connecting device 2 occurs after it is again connected to the support element 1.

As is illustrated in FIGS. 1*a*-1*b*, FIG. 1*d*, and FIG. 4*b*-4*c*, the connecting device 2 may comprise a first wing 18 and a second wing 18. The first and the second wing 18 may be substantially perpendicular to the longitudinal axis 17 of the at least one arm 7. The wings 18 may be configured to engage opposing side surfaces of two decking boards 3, as is illustrated in FIG. 2*a*. The pressure plate 16 may be arranged between the wings 18, such as centered between the wings 18. Alternatively, or additionally, the pressure plate 16 may be arranged between the arms 7, such as centered between the arms 7. The pressure plate 16 may be spaced apart from the bridge member 23. Alternatively, the bridge member 23 may form the pressure plate 16.

Each wing 18 may have a surface 19 generally facing in a direction opposite to the top surface of the pressure plate 16. This provides a three-point engagement arrangement for installing the connecting device 2 by hand or with a tool, which in turn provides for easy installation. For example, the thumb may engage the top surface of the pressure plate 16, and each of the index finger and the middle finger may engage one of the surfaces 19 of the wings 18. Alternatively, a tool, which is not illustrated, may engage these surfaces. The top surface of the pressure plate 16 may be provided in a different plane than the surfaces 19 facing in opposite direction. The plane of the pressure plate 16 may be located closer to the top of the connecting device 2, i.e. farther away from the support element 1 than the surfaces 19 when installed relative the support element 1. Hence, the pressure plate 16 is elevated relative the surfaces 19 in the insertion direction. Hence, convenient and easy installation of the connecting device is provided for, whereby the pressure applied, e.g. by the thumb, can be centered between the wings 18 or arms 7.

The connecting device 2 may comprise at least one projecting element 59. In particular, the connecting device 2 may comprise a pair of projecting elements 59, e.g. as shown in the embodiments in FIGS. 1*a*-*b*, 1*d*, 2*a*-*b* and 4*b*-*d*. The projecting elements 59 are preferably disposed symmetrically with respect to a center portion between the arms 7. At least a portion of the projecting elements 59 may be configured to be provided in the third groove 45 of the second decking board 3 in the installed state. Each projecting element 59 comprises a lower 62*a* and an upper 62*b* surface.

The projecting elements 59 may be disposed between the wings 18 as shown in FIGS. 1*a*-*b*, 1*d*.

In one embodiment, the lower surface 62*a* is provided below the release surface 38 along a vertical direction of the connecting device 2. Thereby, the lower surface 62*a* may abut a lower wall 45*a* of the third groove 45 in the installed state and thereby may serve as a load surface when the boards are loaded. The lower wall 45*a* may be a portion of the third groove 45 facing towards the top surface 42 of the second decking board 3. The release surface 38 may be spaced from the lower wall 45*a* in the installed state.

In one embodiment, the lower surface 62*a* is provided above the release surface 38 along the vertical direction of the connecting device 2. Thereby, the release surface 38 may engage with the lower wall 45*a* in the installed state and hence may serve as a load surface when the boards are loaded. The lower surface 62*a* may be spaced from the lower wall 45*a* in the installed state.

In one embodiment, the lower surface 62*a* and the release surface 38 are provided at the same vertical level. Thereby, both the lower surface 62*a* and the release surface 38 may engage with the lower wall 45*a* in the installed state. Thereby, an increased area of the load surface may be obtained.

In any of the embodiments above, a width of a projecting element 59 along a transversal direction of the connecting device 2 may be smaller than a width of a wing 18. This is shown e.g. in the embodiments in FIGS. 1*a-b*, 1*d* and 4*b-d*. Thereby, a contact area between the wing 18 and the lower wall 45*a* may be larger than a contact area between the element 59 and the lower wall 45*a*. In some embodiments, however, a width of the projecting element may be larger than a width of a wing.

In the embodiments in FIGS. 1*a-b*, 1*d* and 4*b-d*, each projecting element 59 is separated from the first and second wing 18, respectively.

Figure 7A:
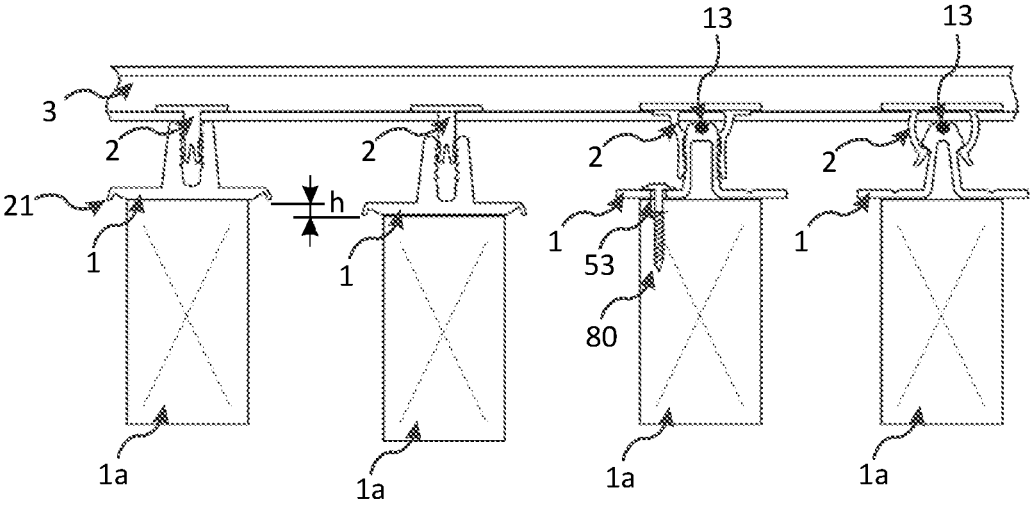
FIGS. 7*a*-7*b* are side views of embodiments of first support elements and second support elements forming a system to be used with embodiments of the connecting device.

As is illustrated in FIG. 3, the support element 1 may comprise at least one bottom surface 20 generally facing the opposite direction of the top surface 4 of the support element. The bottom surface 20 may comprise a drip edge 21 and a support surface 22. A tip of the drip edge 21 may be positioned in substantially the same plane as the support surface, as is illustrated in FIG. 3. Alternatively, the tip of the drip edge 21 may be located vertically closer to the top surface 4 of the support element 1 than the support surface. A groove may be provided between the drip edge and the support surface. The groove may be formed in the bottom surface 20. This provides for installing the support element 1 on a joist without the drip edge 21 interfering with the joist or any other sub-structure, such as is illustrated in FIG. 7*a*. Still, the drip edge avoids that water and particles are trapped between the support element 1 and the joist. When designed for being supported by a joist or other support surfaces, the support element 1 does not need to be strong enough to carry the load applied to the decking without an underlying support surface. However, even if the support element 1 is designed to carry such load, it may be installed on a joist or other support surface that is rigid enough to carry the load. The drip edge 21 illustrated in FIG. 3 may also be provided with other embodiments, such as the support element illustrated in FIG. 1*c*.

As is illustrated in FIG. 1*c*, the support element 1 may comprise a fastener indicator 52, such as a recess. The fasteners indicator 52 may be elongated and extend in the longitudinal direction of the support element 1, such as along the entire or at least a portion thereof. The fastener indicator 52 provides an indication at which a screw or bolt for fastening the support element 1 to the underlying surface should be positioned. Additionally, or alternatively as illustrated in FIGS. 1*c*, 1*e*, and 1*f*, the support element 1 may comprise at least one recess 53 arranged and configured to receive the screw or bolt for fastening the support element 1 to the underlying surface. The recess 53 may be aligned, such as centered, in the fastener indicator 52.

At least one support element 1 may extend along an entire underlying joist, such as to protect the underlying joist from water or moisture and prevent rotting or decaying. Multiple joists may be positioned end to end to form a continuous support element. However, in other embodiments, a gap or distance is provided between two neighboring support elements. The support element should mainly be located at the gap between two decking boards in order to provide adequate support and engagement with the connecting device.

FIG. 1*g* illustrates an embodiment of the connecting device 2, which may be metallic. The connecting device may comprise at least one arm 7, as has been described above. Also, the connecting device 2 comprises a locking member 8, which may comprise one or several protrusions 10 and recesses between the protrusions 10, also as have been described above. Furthermore, connecting device 2 may comprise the first holding member 30 and the second holding member 31. A wing 18 at least partially forms the second holding member 31. When the connecting device comprises two arms 7, as in the embodiment in FIG. 1*g*, the second holding member 31 is preferably provided symmetrically between the arms. In other embodiments (not shown), the metallic connecting device comprises two wings 18, or even three wings 18, preferably with a third wing being provided symmetrically between a first and a second wing. The first holding member 30 and the second holding member 31 may be sized and configured relative the decking boards 3 as have been described above. The pressure plate 16 may extend along the entire width of the connecting device 2, i.e. substantially perpendicularly relative the support element 1 when mounted. Hence, a connecting device 2 does not need to comprise the wings described above. The holding member 30 may extend along the entire length of the pressure plate 16. The second holding member 31 may comprise a snap tab. Furthermore, the second holding member 31 may be formed by a section cut between the first arm 7 and the second arm 7. Hence, the width of the second holding member 31 substantially corresponds to the distance between the first arm 7 and the second arm 7. The locking members 8 may be held by a section extending in the longitudinal direction 17 from an outer part of the arms 7 towards the center or an inner portion of the connecting device 2. The connecting device 2 may be formed by a sheet of metal, e.g. stainless steel, which is bent to form the elements of the connecting device 2. It may also be an, along the width of the connecting device 2, extruded element, e.g. of aluminum, where the protrusions 10 and free space between the arms 7 are punched out in a secondary machining step.

In one embodiment (not shown), the metallic connecting device 2 comprises two arms 7, each arm with a locking member 8 comprising one protrusion 10. The lower portion of the arm may be shaped differently than that in FIG. 1*g*. The protrusion 10 may be provided in a center portion of the lower portion of the arm along a width direction of the arm, i.e. along the longitudinal direction of the support element 1, and may be formed by a section cut in the arm 7. An extension of the protrusion may be at least 25%, preferably at least 35%, more preferably at least 50%, of a total width of the lower portion of the arm. The protrusions 10 of the two arms may be directed towards each other. An outer, preferably flat, surface portion of the protrusion on each arm may be parallel with a lowermost outer, preferably flat, surface portion of the arm. The lowermost outer surface portion on each arm may be inclined or curved outwards away from each other, e.g. inclined outwards with respect to an outer, preferably flat, surface portion of each arm which is provided above a base portion of the protrusion. The locking member 8 of the metallic connecting device with one protrusion on each arm may be configured to provide multiple locking positions relative the support element 1.

Alternatively or additionally, however, it may be configured to provide a single locking position relative the support element 1.

The support element 1 described above with regard to the decking connecting system may be provided as a standalone component, for example as a replacement component. Hence, it may be produced and provided separate from the connecting device 2 and the decking boards 1. The embodiments of the support element 1 when provided independently will not be repeated. With regard to the design of the support element 1, reference is made to the forgoing description of the decking connecting system.

Similarly, the connecting device 2 described above with regard to the decking connecting system may be provided as a standalone component, for example as a replacement component. Hence, it may be produced and provided separate from the support element 1 and the decking boards 3. However, the embodiments of the connecting device 2 when provided independently will not be repeated. With regard to the design of the connecting device 2, reference is made to the forgoing description of the decking connecting system. The connecting device may be provided as a single component.

Figure 1K:
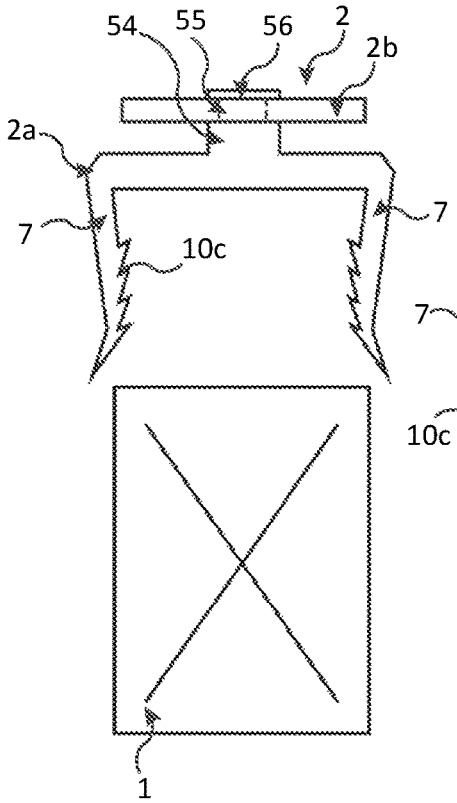
FIGS. 1*k*-1*p* are side views and a top view of embodiments of a multi-member connecting device and illustrating different locked positions of the connecting device relative the support element.
Figure 1L:
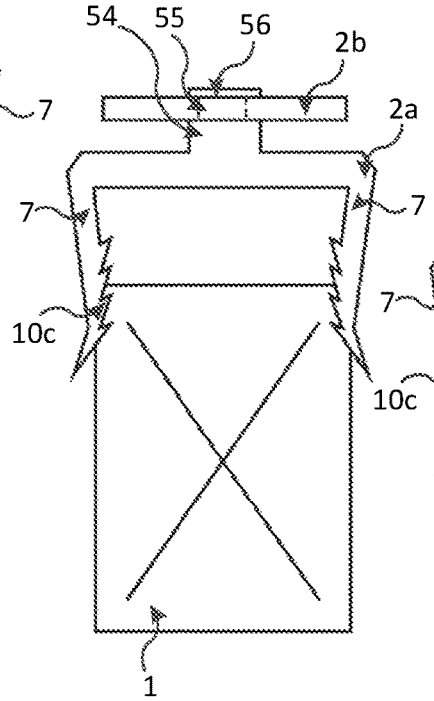
Figure 1M:
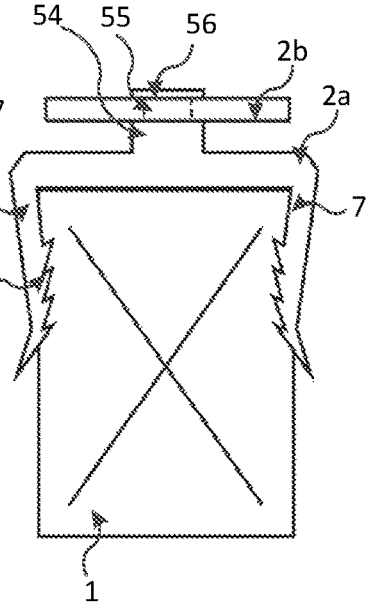

FIGS. 1*k*-1*p* illustrate embodiments wherein the plurality of locking positions may be continuous, i.e. not positioned at predefined locations of the support element 1. The connecting device 2 is configured for releasably fasten at least one decking board 3 to the support element 1 of the connecting system. In addition to the embodiments as described above, the at least one arm 7 with the locking member 8 may be configured for engagement with an engagement surface of the support element 1. The locking member 8 of the connecting device 2 may provide the engagement surface. However, in other embodiments such as illustrated in FIGS. 1*k*-1*p*, the support element is a joist, which may have substantially flat side surfaces. For clarity, the joist is not shown in FIGS. 1*n*-*p* and FIGS. 2*d*-*e*. The joist may e.g. be a wooden joist or WPC joist. The locking member 8 may engage the joist, such as by protrusions engaging into the side surfaces. The protrusions may e.g. be barbs or teeth 10*c* that are relatively sharp such that they engage and/or extend into the side surfaces of the joist. The barbs or teeth 10*c* may be punched out from the arms 7, preferably comprising a metal, such as stainless steel. The tip of the barbs or teeth 10*c* may be directed towards the proximal end of the connecting device 2. Hence, if multiple barbs or teeth 10*c* are provided, the barbs or teeth 10*c* may gradually engage the support element 1 further and further, such as when the decking board 3 is loaded, i.e. at undefined locations such as depending on the load applied on the decking board 3. For example, multiple barbs or teeth 10*c* may engage the support element 1, wherein multiple locking positions are provided. The barbs or teeth 10*c* are provided along a vertical direction of the arm 7 and preferably are horizontally offset as shown explicitly in the embodiments FIGS. 1*n* and 1*p* but are equally conceivable in the embodiments in FIGS. 1*k*-*m*. Hence, the locking member 8 comprises a plurality of protrusions forming a plurality of locking positions of the connecting device 2 relative the support element 1. In FIG. 1*k*, no teeth engage the joist. In FIG. 1*l*, a first position of the connecting device 2 relative the support element 1 is provided, wherein at least one tooth of each arm 7 engages the support element 1. In FIG. 1*m*, a second position of the connecting device 2 relative the support element 1 is provided, wherein multiple teeth 10*c* of each arm 7 engage the support element 1.

Alternatively, or additionally, the joist, which may be wooden or made of WPC, may be profiled with one or several longitudinal grooves and tongues along one or both of the side surfaces. The connecting device 2 may engage the longitudinal grooves, such as described above. Alternatively, the connecting device may engage the wooden or WPC joist in a single position, such as with a snap fit locking member, a clip, a clamp etc. The connecting device 2 may be made as a single structure or in one piece, or may comprise multiple structures or be made of multiple pieces, such as described with regard to Aspect 5. In any of the embodiments described above, the connecting device may lock with a pretension, holding the board 3 firmly against the support element 1.

Figure 8A:
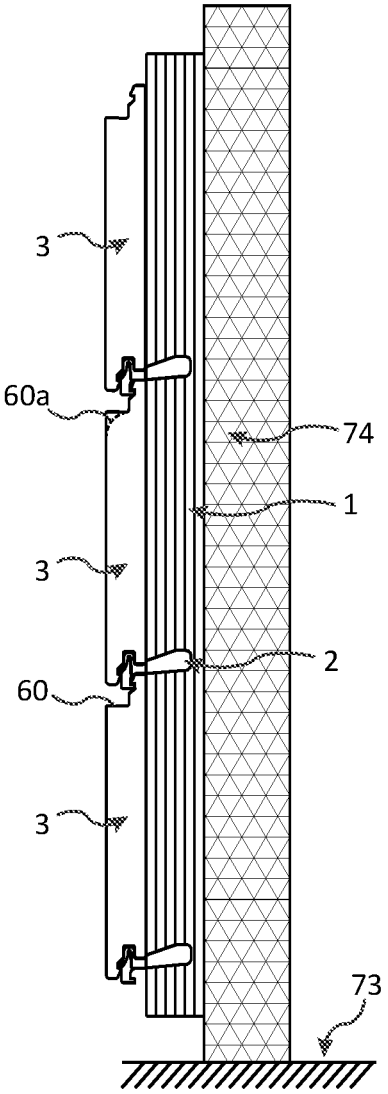
FIG. 8*a* illustrates a side view of an embodiment of a connecting system for cladding.

Embodiments of aspect 1, illustrated in FIG. 8*a*, comprise a connecting system for cladding, wherein one or a plurality of boards or panels are mounted on a wall. For definitions of directions in relation to cladding, see above. The connecting system comprises a support element 1 that is provided such that its longitudinal direction extends perpendicularly to a base portion 73, such as a floor or a ground. The support element 1 is connected to a wall element 74, e.g. by screws or nails. According to an alternative embodiment, the wall element 74, may be provided at an angle w.r.t. the base portion 73, such as at 0-45 degrees. Moreover, the connecting system comprises the connecting device 2 configured to releasably fasten the at least one board 3 to the support element 1 in the "vertical" direction with respect to the support element 1 (horizontally in FIG. 8*a*).

Any of the embodiments of the support element 1, the connecting device 2 and boards 3 described in relation to aspects 1-8, including items 1-56, and FIGS. 1*a*-*p*, 2*a*-*f*, 3, 4*a*-*d*, 5*a*-*g*, 6*a*-*c*, 7*a*-*b* and 8*b*-*c* of the present disclosure may be used also for cladding. Preferably, however, the side surfaces 60, 61 of the cladding boards 3 are not symmetric about the diagonal. The boards preferably do not comprise a tongue 49*b* as that of the boards in e.g. FIGS. 2*a*-*c*, 5*a*-*f* and 6*a*-*c* since the resulting fourth groove 69 may collect water. Moreover, the side surface 60 of the cladding boards 3 which is directed upwards may be configured to direct liquids, such as water, away from the boards. For example, as illustrated in FIG. 8*a* by the broken line 60*a*, the side surface 60 may be inclined or curved.

Finally, it is noted that in the case of cladding, "vertical" locking of the board relative the connecting device is essential, but not in the "horizontal" directions. One reason for this is that the boards are pulled downwards by gravity in the "horizontal" direction. In particular, the transversal locking of the first board relative the connecting device using the first holding member 30 is optional and may be left out. Alternatively or additionally, the part of the second holding member 31 which locks the second board transversely relative the connecting device may be left out.

Aspect 2

Embodiments of aspect 2 comprise the connecting device 2 for the connecting system, which will be described below with reference to e.g. FIGS. 1*a*-*b*, 1*d*, 1*g*, 2*a*-*c*, 5*c*-*f*, 6*a*-*c* and 8*c*. The connecting device 2 has a vertical direction and a transversal direction perpendicular to the vertical direction. The transversal direction is generally in the transversal direction of the decking boards. The vertical direction is generally perpendicular to the transversal direction and generally perpendicular to the decking. Horizontal/transversal/longitudinal and vertical are used to denote first and second directions that are mutually perpendicular and depends in the installation of the decking, but is used since a decking normally is installed to extend in the horizontal plane with its longitudinal direction, i.e. the length direction of the decking board 3, and its transversal direction, i.e. its width direction.

The connecting device 2 comprises the locking member 8 for vertically locking the connecting device 2 relative the support element 1. With regard to aspect 2, the locking member 8 of the connecting device may be configured to provide multiple positions relative the support element 1, as has been described above with regard to aspect 1. Such embodiments are shown in e.g. FIGS. 1*a-b*, 1*d*, 1*g*. However, in other embodiments, the locking member 8 of the connecting device 2 and the locking member 6 of the support element 1 may be engaged in a single locking position relative each other. This may be provided by a single protrusion and a mating valley or recess, according to the same principles as has been described with regard to aspect 1.

The connecting device 2 may comprise at least one first holding member 30 configured to lock a first decking board 3 transversally relative the connecting device 2. In some embodiments, the first holding member 30 is configured to lock the first decking board 3 vertically relative the connecting device and/or the support element 1. Also, the connecting device 2 may comprise at least one second holding member 31 configured to lock a second decking board 3 transversally relative the connecting device 2. In some embodiments, the second holding member 31 is configured to lock the second decking board 3 transversally relative the connecting device 2. The connecting device may as such be moveable relative the support element 1.

At least one first holding member 30 means that the first holding member 30 may be split in two or more. Each of the first holding members 30 may lock the first decking board 3 in the transversal direction. In other embodiments, one of the first holding members 30 is configured to lock the first decking board 3 in the transversal direction whereas another of the first holding members 30 is configured to lock the first decking board 3 in the vertical direction.

Similarly, at least one second holding member 31 means that the second holding member 31 may be split in two or more. Each of the second holding members 31 may lock the second decking board 3 in the vertical direction. In other embodiments, one of the second holding members 31 is configured to lock the second decking board 3 in the vertical direction whereas another of the first holding members 31 is configured to lock the first decking board 3 in the transversal direction.

Hence, the connecting device 2 may be configured to allow the decking boards to move in the longitudinal direction. Furthermore, lock and locking in the transversal direction means that the connecting device 2 and the decking system is configured to allow the decking boards 3 to move in the transversal direction due to environmental effects without the connecting device disengaging or unlocking from the decking boards. Thereby, separation forces due to shrinkage of the decking boards are accounted for with the transversal locking. Hence, locking in the transversal direction means that the decking boards 3 may move due to the environmental effects also in the transversal direction. For example, the connecting device 2 may be slightly flexible, such that the distance between the first holding member 30 and the second holding member 31 extends or follows the movement of any of the decking boards of the decking in the transversal direction. Hence the connecting device 2 may extend in response to movement of one or several of the decking boards 3 in the transversal direction. Alternatively, or additionally, the connecting device 2 and/or the decking boards 3 are configured with sufficient tolerance or clearance that allows for movement of the decking boards 3 in the transversal direction. In such embodiments, the connecting device may be more rigid. However, the connecting device 2 may also be flexible even if tolerance and/or clearance is built into the system. In still other embodiments, substantially no clearance or less clearance than the maximum movement, such as movement due to environmental effects, of the decking boards in the transversal direction is built into the system, and the connecting device 2 is fairly rigid and substantially maintains its shape in response to movement of the decking boards 3. In such embodiments, the integrity of the connecting device 2 is sufficiently strong such that the entire decking may move in the transversal direction. For example, the installed boards may move in the transversal direction as a single unit, such as an entire decking.

The tolerances should be sufficient to allow the decking board to shrink around its longitudinal axis. Each locking joint between the connecting device 2 and the decking board 3 should allow such shrinkage with maintained locking of the decking board 3 relative the connecting device 2. For example, the distance or gap between two decking boards, i.e. in the transversal direction of the decking boards, made of WPC may become larger, i.e. the decking boards shrink, up to 1 mm, such as about 0.5 mm, more typically about 0.1 mm. The distance or gap between decking boards made of wood may become up to 6 mm larger due to environmental effects. Decking boards made of bamboo or a bamboo composite typically shrink less than decking boards made of wood. The tolerances of the locking joint between the connecting device 2 and the decking boards 3 may handle such shrinkage without the connecting device 2 disengaging from the decking boards 3 due to the shrinkage of the decking boards. In case the shrinkage is larger than the tolerances, the locking joint is sufficiently strong such that the entire decking may move, particularly in situations wherein the connecting device 2 is moveable in the longitudinal direction of the support element 1, i.e. in the transversal direction of the decking boards 3. Hence, the forces that need to be accounted for is lower for decking boards comprising WPC or bamboo compared to decking boards made of wood.

The first holding member 30 may comprise a hook with a tip 32 pointing towards the locking member 8. The hook may have a first surface 33 and a second surface 34 extending at least partially in the vertical direction. The second holding member 31 may comprise a first stop surface 35 and a second stop surface 36. The first stop surface 35 and the second stop surface 36 face at least partially in transversally opposing directions, i.e. in the transversal direction of the decking boards 3, when installed. The tip 32 of the hook is transversally spaced apart from the locking member 8.

The connecting device 2 may be used in a connecting system that comprises the connecting device 2, a first decking board 3 configured to extend in a longitudinal direction and a transversal direction, and a second decking board 3 configured to extend in the longitudinal direction and the transversal direction. The first decking board 3 comprises a first groove 40 that extends in the longitudinal direction. The first groove 40 has an opening 41 that faces towards a top side 42 of the first decking board. Also, the first groove 40 may be configured to at least partially receive the first holding member 30. The second decking board 3 comprises a second groove 43 that extends in the longitudinal direction and is configured to receive at least a portion of the second holding member 31. With this configuration, the first holding member 30 when engaged in the first groove 40 locks the first decking board 3 in the vertical direction. The first stop surface 35 and the second stop surface 36, which engage surfaces of the first decking board, locks the first decking board 3 in the transversal direction of the decking board 3. The second holding member 31 may hold the second decking board 3 at least in one transversal direction of the second decking board 3. Hence, the first decking board 3 and the second decking board 3 will not be separated in the transversal plane as one of the decking boards 3 is locked in the vertical direction. The decking boards may have the first groove 40 at one of its longitudinal side surfaces and the second groove 43 on the other of its longitudinal side surfaces. A connecting device 2 may be fastened at each side of a single decking board 3. Hence, since it is locked at one of its longitudinal side surfaces, it is locked in the vertical and horizontal direction.

In some embodiments, the first groove 40 and the second groove 43 are symmetrical. Hence, a decking board may be flipped around such that a groove that was the first groove 40 before flipping around becomes the second groove 43 when flipped around, and vice versa. Hence, the flexibility of the system is improved.

Figure 6A:
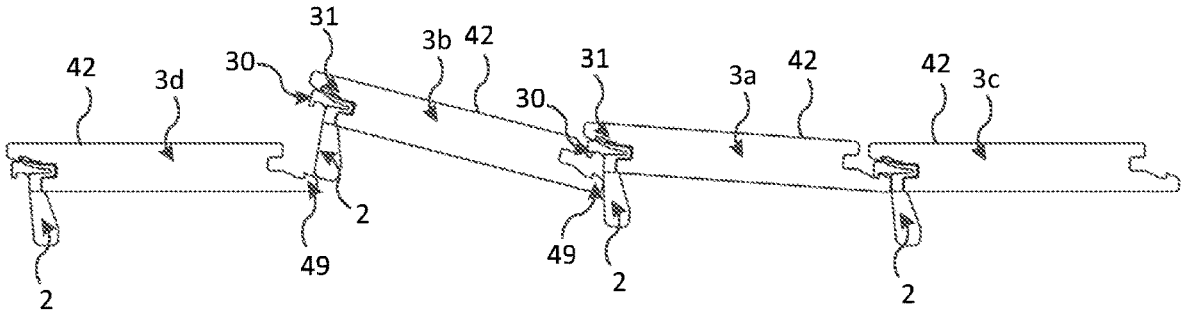
FIGS. 6*a*-6*c* are side views of an embodiment of a system illustrating embodiments of methods for taking up a board in a plurality of boards.
Figure 6B:
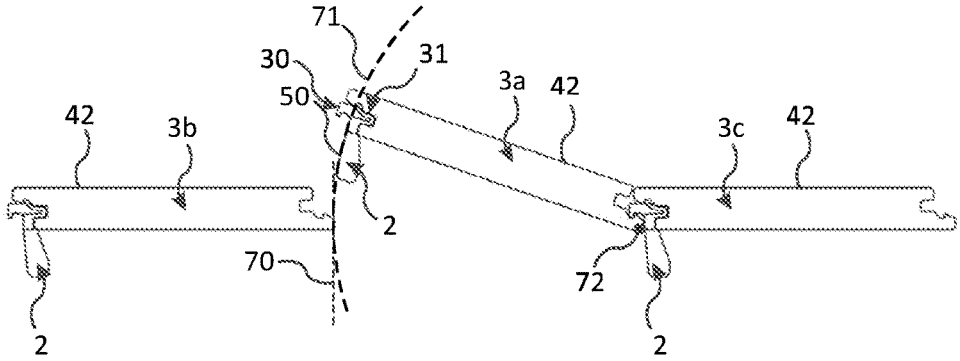
Figure 6C:
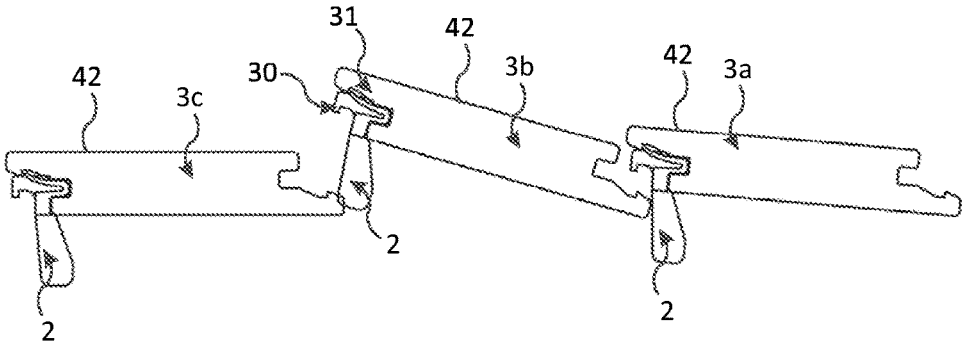

The first groove 40 and/or the second groove 43 may have side walls extending parallel to the vertical direction against which the connecting device 2 locks, such as the hook and/or the snap tab of the connecting device 2. Parallel side walls are illustrated in FIG. 2*a*. Alternatively, the side wall may be angled at a non-zero degree relative the vertical direction. For example, the side walls may be angled with a negative angle relative the vertical direction, i.e. the side wall against which the connecting device locks may extend from the opening of the groove towards the edge or tongue of the decking board 3, i.e. towards the gap between two decking boards when mounted. A negative angle increases the locking force between the connecting device 2 and the decking board 3 in the transversal direction. The negative angle may be in the range of −1 to −10 degrees relative the vertical direction. This may provide a distinct locking and at the same time a relative small play between the connecting device 2 and the decking board 3. At a depth of the groove 40, 43 of about 2 mm and −10 degrees angle of the wall, a play of 0.4 mm is achievable. In other embodiments, the angle of the wall is positive, wherein easier disengaging of the connecting device 2 relative the decking board 3 is achievable. The angle of the wall may be in the range of 10 to −10 degrees, such as 1 to −1 degrees. However, angles of between 45 to −45 degrees are foreseeable. The second holding member 31 may comprise at least one protrusion 37 with a release surface 38 that extends in the transversal direction of the connecting device 2 and faces towards the locking member 6. The protrusion 37 may e.g. extend from the wing 18 of the connecting device 2 and in the transversal direction of the connecting device 2, i.e. the transversal direction of the decking board when installed. The protrusion may extend into the third groove 45 of the second decking board 3 that extends in the longitudinal direction of the second decking board 3. The third groove 45 may be provided between the second groove 43 and a bottom surface of the second decking board. The third groove 45 may have an opening 46 facing in the transversal direction of the second decking board 3. The release surface 38 of the protrusion 37 extends in the transversal direction, and faces towards the locking member 6. The release surface is configured to abut a portion of the third groove 45, which portion faces towards a top surface 42 of the second decking board 3. Hence, when it is desired to take up a decking board, the second decking board may be tilted or angled as is illustrated in FIGS. 6*a*-6*c* and further described below with regard to aspect 4, the connecting device 2 remains in the second decking board. Hence, a pressure is applied via the third groove 45 to the release surface 38, whereby the connecting device is released from the support element 1.

There may be a vertical space between the protrusion 37 and an upper wall 45*b* of the third groove 45 in the installed state, see e.g. FIG. 5*b*. The upper wall 45*b* preferably is a portion of the groove 45 facing towards the bottom surface 51 of the second decking board 3. Alternatively, however, the protrusion 37 may engage with the upper wall of the third groove 45, see e.g. FIG. 2*a* or 2*b*.

A fourth groove 69 may be provided in the side surface 60. The fourth groove 69 shown in the embodiment in FIG. 2*a* is provided between the tongue 49 and the tongue 49*b* and has an opening facing in the transversal direction.

Figure 2B:
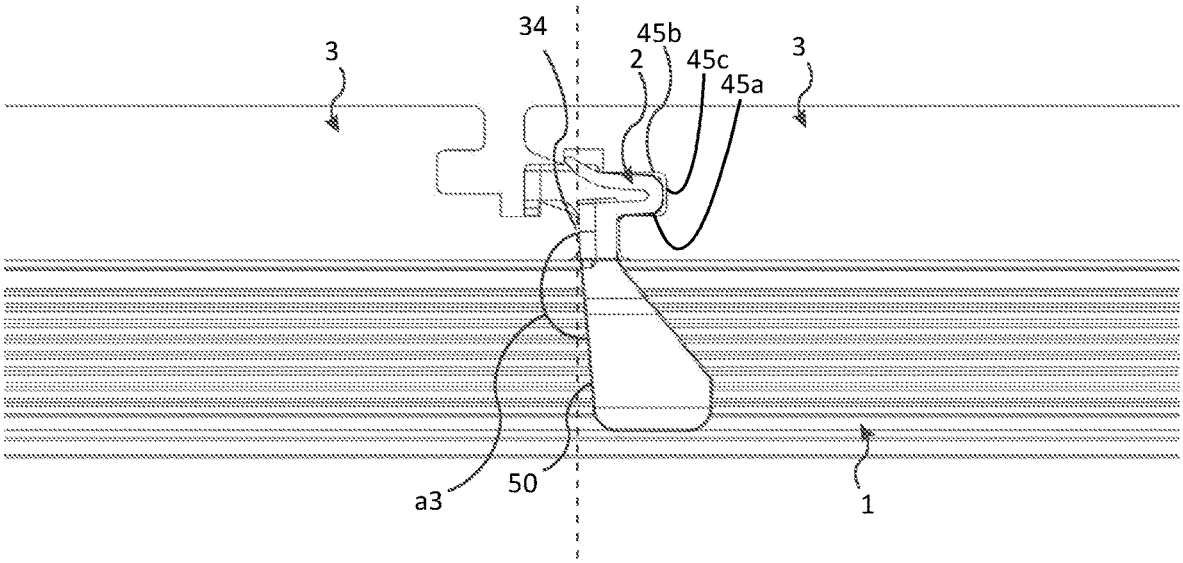
FIG. 2*b* is a side view of an embodiment of the connecting device with an edge of the arm angled relative a second surface.
Figure 2C:
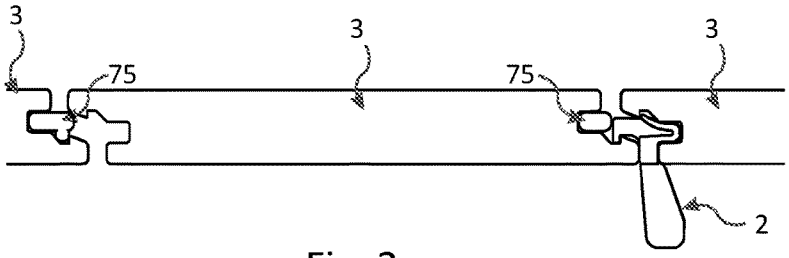
FIG. 2*c* is a side view of an embodiment of a connecting system comprising a filling material.

As shown in FIG. 2*c*, the fourth groove 69 and/or the tongue 49 may comprise a filling material 75. The filling material may be decorative and/or protective, e.g. protecting the board from accumulating liquids, such as water. The filling material 75 may comprise one or several materials of rubber, plastic, a water-resistant material or coating, a colour material, such as paint, e.g. water-resistant paint, or wax. The filling material may have an essentially constant cross-section along the longitudinal direction of the boards 3. Optionally, as shown in FIG. 2*c*, the filling material may have a different, preferably smaller, cross-section where the connecting device 2 is provided. Clearly, the embodiment described above utilizing a filling material may also be used in embodiments of the aspects 1 and 3-9.

The second holding member 31 may be configured as a snap tab with a tip forming the first stop surface 35 and pointing in a direction towards the first holding member 30. The tip of the snap tab may be configured to be received at least partially into the second groove 43, which comprises the opening 44 facing towards a bottom side of the second decking board 3. Alternatively, the snap tab is only received in the third groove 45, e.g. sized to fit snugly in the third groove 45. Hence, connecting device may first be positioned to lock the first decking board 3. Then, the second decking board 3 may be transversally pushed towards the first decking board 3 and snapped in place by the snap tab and then locked in the vertical as well as the transversal direction also by the second holding member 31, whereby locking in the transversal direction is provided along both longitudinal sides of the decking boards 3. In other embodiments, the first holding member is configured as a snap tab. Additionally or alternatively, the second holding member may be configured as a hook.

The second holding member 31 may be generally V- or U-shaped with a first and a second leg. One leg may form the snap tab with the tip forming the first stop surface 35 and pointing in a direction towards the first holding member 30. The other leg may form the release surface 38 that extends in the transversal direction and faces towards the locking member 8 of the connecting device.

The first decking board 3 may comprise a first holding surface 47 and a second holding surface 48, which extend at least partially in the vertical direction. The first surface 33 of the hook of the connecting device 2 may be configured to abut or be supported the first holding surface 47. The second surface 34 of the hook of the connecting device 2 may be configured to abut or be supported by the second holding surface 48. This provides for locking the first decking board 3 in the transversal direction. However, it may still change its shape in the longitudinal direction, such as when exposed for environmental effects. Abutting or supporting in this context means that the first surface 33 of the hook does not need to abut or be supported by the first holding surface 47 at the same time as the second surface 34 of the hook is abuts or is supported by the second holding surface 48. Clearance and tolerances may be provided such that only one of the first surface 33 and the second surface 34 of the hook is abutting or is supported at the time. Still the clearance or production tolerances should be sufficiently tight to prevent that the hook is released from the decking board 3 during load or exposure to other environmental effects.

In some embodiments, the first holding surface 47 is formed within the first groove 40 and the second holding surface 48 is formed by a tip of a tongue 49 of the first decking board 3. The tongue 49 may be configured to be received at least partially between the first surface 33 of the hook of the connecting device and the second surface 34 of the hook of the connecting device. When the first groove 40 and the second groove 43 are symmetrical, this provides for the tongue 49, when in the second decking board, being configured to cover at least a portion of the connecting device 2 from the top side 42 of the decking board 3. In other embodiments, such as that shown in FIG. 8*c*, the first groove 40 may be dimensioned such that the opposing side surfaces of the flange 39 fits into the first groove 40 and is supported by walls or side surfaces of the first groove 40, and whereby the connecting device 2 holds the first decking board 3 in the transversal direction. Again, sufficient production tolerances and clearance should be provided such that the opposing side surfaces of the flange 39 fits in the first groove 40 but not too large such that the connecting device is released from the groove 40.

The tongue 49 may have a bevel or chamfer at least at one of its edges of its free end, as is illustrated in FIG. 6*c*. This provides for the arms 7 being guided along the bevel or chamfer. This is particularly useful when the arms 7 are not spaced apart from the tongue during the tilting motion, as is further described below with regard to FIG. 6*c*. The edge 50 of the arms may at least partly engage the tongue 49 during the tilting motion.

Furthermore, the arms 7 may have a bevel or chamfer at the edge facing the tongue 49. In still other embodiments, a combination of guiding surfaces on both the connecting device 2 and the decking board 3 may be provided. During such guidance, the connecting device 2 may be temporarily tilted and the narrow space between the decking boards described above will guide the connecting device 2 back to a mainly vertical alignment. Guiding surfaces may be provided in embodiments wherein the connecting device 2 is maintained in the decking board during tilting. It may be used in embodiment wherein locking in the transversal direction is provided. Furthermore, it may be provided in embodiments where no locking in the transversal direction is provided.

Furthermore, the tongue may be tilted from the free end of the tongue 49 upwards towards the top surface 42. This facilitates engaging the connecting device 2, such as the hook, by sliding a decking board with the tongue 49 towards the connecting device 2 and snap fitting the decking board being slid until the connecting device 2 engages the tongue 49.

In some embodiments, the pressure plate 16 is generally arranged perpendicularly to the locking member 8, as has been described with regard to aspect 1 and will not be repeated with regard to aspect 2. The pressure plate may have a flange 39 that extends from the pressure plate 16 and forms a free end portion of the hook. This embodiment may also be used in aspect 1.

The connecting device 2 may comprise the wings 18 as has been described with regard to aspect 1. At least one of the first wing 18 and the second wing 18, between which said pressure plate 16 may be arranged, may at least partially form the second holding member 31.

In some embodiments, the first decking board 3 comprises the tongue 49 with the tip, and the locking member 8 of the connecting device comprises the at least one arm 7, as has been described with regard to aspect 1. The arm may be configured to extend in the vertical direction between the tongue of the first decking board 3 and the second decking board 3. An edge 50 of the arm 7, which faces in a direction towards the tongue 49 of the first decking board 3, is at least partially offset in the transversal direction from the tip of the tongue 49. This provides for angling or tilting the second decking board 3 with the connecting device 2 maintained in the second decking board with the edge 50 spaced apart from the tip along the entire tilting motion, or at least partly during of the tilting motion, of the second decking board 3. In some embodiments, there is a space provided between the tip of the tongue and the edge 50 when the second decking board is in the locked position. In other embodiments and as is illustrated in FIG. 2*b*, the edge 50 of the arm is angled an angle a3. Angle a3 may be more than 180 degrees relative the second surface 34, such as a stop surface, of the connecting device 2, which is configured to abut the tongue of the first decking board. The second surface may be parallel with the axial direction of the connecting device 2.

Figure 5C:
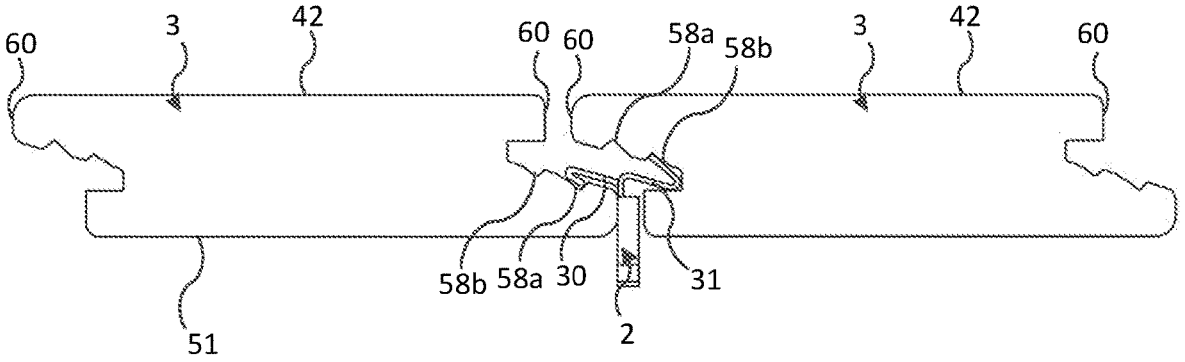
FIGS. 5*c*-5*e* are side views of embodiments of the connecting device.
Figure 5D:
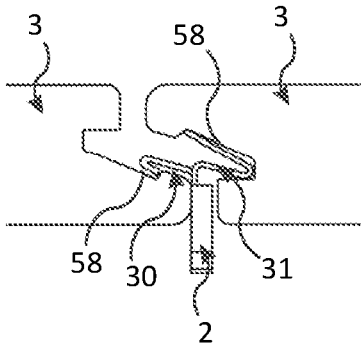
Figure 5E:
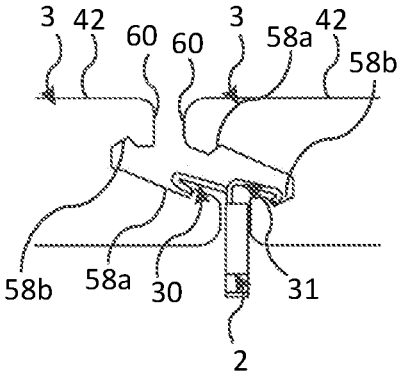

FIGS. 5*c*-5*e* illustrate embodiments of the connecting device 2 with the first holding member 30 and the second holding member 31. At least one of the first holding member 31 and the second holding member 31 may be formed as a snap-tab that engages a groove of a side surface 60 of the decking board 3. This arrangement is useful for decking boards, such as made of wood or bamboo, wherein at least a portion of the side surface 60 is profiled with a rotating cutting tool 57. A rotating cutting tool 57 cannot provide undercuts, which may be provided, e.g., when the decking board 3 is made by extrusion.

The snap tab of each holding member 30, 31 may extend from a center of the connecting device 2, be curved at its outermost end, and return back with its free end towards the center of the connecting device 2. The snap tab of the first holding member 30 may be curved with the free end towards the portion of the connecting device 2 attached to the support element 1, i.e. towards the bottom surface 51 of the decking board. The snap tab of the second holding member 31 may be curved with its free end away from the portion of the connecting device 2 attached to the support element 1, i.e. towards the top surface 42 of the decking board 3. The curved portion of the snap tab of the second holding member 31 may be received in a groove of the panel, which may extend in the transverse direction of the decking board. Movement of the decking board 3, e.g. due to environmental effects, may be provided by flexibility of at least one of the snap tab of the first holding member 30 and the snap tab of the second holding member 31, preferably the snap tab of the second holding member 31.

The free end of the first holding member 30 and/or the second holding member 31 may be wedge or arrow shaped in order to protrude into the surface or wall of the groove. Hence, the free end is not parallel to the wall of the groove when it is seated therein. This provides for preventing that the holding member disengages from the groove. Any embodiment of the first holding member 30 and/or the second holding member 31 disclosed herein may comprise such a wedge or arrow shaped free end.

In the embodiments of FIGS. 5*c* and 5*e*, each side surface 60 of the decking board 3 is symmetric and comprises a first groove portion 58*a* and a second groove portion 58*b*. The first holding member 30 is configured to be received in the first groove portion 58*a*. The second holding member 31 is configured to be received in the second groove portion 58*b*. The second groove portion is located closer to the center of the decking board 3 than the first groove portion 58*a*.

As is illustrated in FIG. 5*e*, each of the first holding member 30 and the second holding member 31 may engage the decking board 3 at a tongue being positioned towards the support element. The tip or free end of the first holding member 30 and/or the second holding member 31 may engage a wall portion of the first groove portion 58*a* and the second groove portion 58*b*, respectively. The wall portion extends non-parallel to the transversal extension of the decking board 3 and is facing towards the top surface 42 of the decking boards 3. There may be some play between the connecting device 2 and the side surface 60, but any gap must be sufficiently small such that the first holding member 30 and/or the second holding member 31 remain in the first groove portion 58*a* and the second groove portion 58*b*, respectively, and do not allow the connecting device 2 to disengage, such as if the connecting device 2 is slightly tilted relative the support element 1.

In the embodiments of FIGS. 5*c*-5*e*, each side surface 60 of the decking board 3 is symmetric about the diagonal.

In the embodiment of FIG. 5*d*, each side surface 60 of the decking board 3 comprises a single groove portion 58 for receiving each holding member 30, 31.

A tip of each snap tab may engage a side surface of a wall of the groove portion 58, 58*a*, 58*b*. The wall may be facing towards the center of the decking board 3 and be angled at a non-zero degree relative the transversal direction of the decking board 3. Hence, the decking boards may be held in the transversal direction. The connecting device may be releasably or non-releasably attached to the support element 1 as described with regard to the other aspects and embodiments disclosed herein.

Figure 5F:
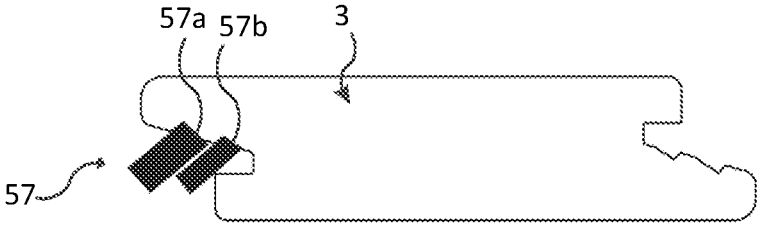
FIG. 5*f* is a side view of a tool for profiling a board.

FIG. 5*f* illustrates a cutting tool 57 with a first cutting edge or surface 57*a* for forming the first groove portion and a second cutting edge or surface 57*b* for forming the second groove portion 58*b*.

Aspect 3

Embodiments of aspect 3 comprise a decking system, which will be described below with reference to e.g. FIGS. 2*a*-*c*, 6*a*-*c* and 8*b*-*c*. The first decking board 3 may be configured to extend in the longitudinal direction and the transversal direction, as described with regard to aspect 1 and aspect 2 and in relation to e.g. FIGS. 2*a*-*c*. The first decking board 3 has the top surface 42, the bottom surface 51 and at least one side surface 60 that extends between the top surface 42 and the bottom surface 51. The second decking board 3 is configured to extend in the longitudinal direction and the transversal direction of the decking board 2. The second decking board has the top surface 42, the bottom surface 51 and at least one side surface that 61 extends between the top surface 42 and the bottom surface 51. The connecting device 2 is configured to hold the first decking board 3 and/or the second decking board 3 in at least one transversal direction. Furthermore, the connecting device 2 comprises the locking member 8 for locking the first decking board and the second decking board in the vertical direction relative the connecting device and/or support element 1.

The second decking board 3 is tiltable from a locked position, as is illustrated in FIGS. 6*a*-6*c* with decking boards 3*a*, 3*b* (that are referred to as first decking boards below for the purpose of a method for taking up the decking board), wherein it is transversally locked to the first decking board 3, to an unlocked position, as illustrated in FIGS. 6*a*-6*c* with the center decking boards, wherein the connecting device 2 and, thus, the second decking board 3, 3*a* is transversally unlocked from the first decking board 3. The position of the connecting device 2 relative the second decking board 3, 3*a* is substantially maintained, at least partially during tilting of the second board, between the locked position and the unlocked position, as can be seen in the decking board being tilted in FIGS. 6*a*-6*c*. The position of the connecting device 2 relative the second decking board 3, 3*a* may be substantially maintained during tilting up and/or during tilting down. Hence, the connecting device 2 is held in place in the second decking board 3, 3*a*, 3*b* during the tilting motion. However, it does not need to be maintained during the entire tilting motion. For example, it may be maintained until the connecting device engages, during tilting down, or disengages, during tilting up, to/from the support element 1. Once the second decking board 3, 3*a* is unlocked, the first decking board 3, 3*b*, or the second decking board 3*a*, may be taken up, such as to be replaced or flipped around as has been described previously with regard to aspect 1 and aspect 2. This embodiment may be provided together with multiple locking positions, as described with regard to aspect 1, or with a single vertical locking position as described with regard to aspect 2. Furthermore, this aspect may be provided with vertical and transversal locking as has been described above with regard to aspect 2. Particularly, aspect 1 provides embodiments for easy, stable and flexible installation, aspect 2 provides embodiments for flexible installation as well as a stable connection during use, and this aspect 3 provides embodiments for flexible installation of a replacement decking board or re-installation of a decking board that is flipped around. Each embodiment of the various aspects may therefore be combined into a decking system and contribute to advantages of the decking system as described with regard to the aspects. Furthermore, each embodiment of the various aspects is useful for systems wherein the decking boards 3 cannot be flipped around but have to be replaced, e.g. when damaged.

In some embodiments, the locking member 8 of the connecting device 2 may comprise the at least one arm 7 as described with regard to the embodiments of aspect 1 and aspect 2. A portion of the connecting device 2 may be configured to be received within the side surface 61 of the second decking board 3 such that the edge 50 of the arm 7 faces in a direction towards the side surface 60 of the first decking board 3. The arm 7 may be configured to extend between the side surface 60 of the first decking board 3 and the side surface 61 of the second decking board 3 and beyond the bottom sides 51 of the first decking board 3 and the second decking board 3, respectively. The edge 50 of the arm 7 may be configured to be at least partially offset in the transversal direction from the side surface 60 of the first decking board 3, as has been described with regard to embodiments of aspect 2. Hence, the edge 50 of the arm 7 is spaced apart from the side surface 60 of the first decking board 3 at least partly while second decking board 3 is tilted from the locked position to the unlocked position. Hence, the second decking board 3 may be tilted without the connecting device 2 interfering with the first decking board. If it was not spaced apart, the connecting device 2 could jam between the first decking board 3 and the second decking board 3, wherein the latter could not be tilted enough for the first decking board 3 to be taken up. However, the arm 7 may engage or abut the first decking board, such as the tongue 49, at least partly during the tilting motion without jamming. This is e.g. possible if there is enough flexibility in the connecting device 2 or sufficient play or tolerances between the connecting device 2 and the second decking board 3, to which the connecting device 2 is attached during the tilting motion.

The connecting device 2 may comprise a flexible element 78 arranged to abut a portion of at least one of the decking boards, such as the edge or a wall of the groove of the decking board. The flexible element may be configured and sized to provide a pre-defined distance or gap between the decking boards 3 when mounted. The flexible element may be configured to be compressed when the decking boards are mounted or when the decking boards are exposed to environmental effects. As the decking boards 3 shrink or expand, the flexible element flexes. The flexible element may flex about 1-2 mm. This may prevent that the connecting device is dislocated and become tilted and eventually disengaged and unlocked from the decking board. Hence, the flexible element may be located between the gap between two decking boards when mounted. Hence, the gap may provide a seat for the flexible element. The flexible element may comprise a leaf spring element. Furthermore, a play between the connecting device 2 and the decking boards 3 may be provided, such as described above. Hence, the flexible element and/or the play may provide for decreasing the required strength of the connecting device 2. Movement of a decking board 3 due to environmental effects may be taken up by the flexible element and/or the play, instead of moving the entire decking or a plurality of decking boards 3 when no play and/or no flexible element is provided. The flexible element and/or play may be provided regardless if he connecting device 2 is fixed vertically or not.

Figure 8B:
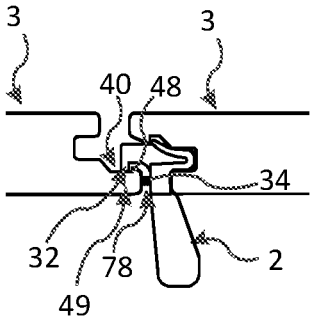
FIG. 8*b* is a side view of an embodiment of the connecting device locking boards and being locked to the support element, wherein a flexible element is provided between the boards.

In the embodiment illustrated in FIG. 8*b*, a flexible element 78 is provided between the first and second boards, between the tongue 49 and connecting device 2, preferably between an outer part of the tongue 49 and the second surface 34 of the hook. The flexible element may be configured to exert of force on the connecting device transversely outwards, away from the first board 3. Thereby, the connecting device may be guided into a proper position.

As described above, the second decking board 3 in its side surface 61 may comprise the third groove 45 that extends in the longitudinal direction of the second decking board 3. The third groove 45 may have an opening 46 facing in the transversal direction. The holding member 31 of the connecting device 2 may comprise the release surface 38 that extends in the transversal direction and faces towards the locking member 8 and is configured to abut the portion of the groove 45, which portion faces towards the top surface 42 of the second decking board 3, as has been described with regard to embodiments of aspect 2.

The first decking board 3 in its side surface 60 may comprise the first holding surface 47 and the second holding surface 48, which extend at least partially in the vertical direction. The first surface 33 of the hook of the connecting device 2 is configured to abut the first holding surface 47, and a second surface 34 of the hook of the connecting device 2 is configured to abut the second holding surface 48, as has been described with regard to embodiments of aspect 2. The first holding surface 47 may be formed within the groove 40 of the side surface of the first decking board 3, and the second holding surface 48 may be formed by a tip of the tongue 49 of the first decking board 3. The tongue 49 may be configured to be received at least partially between the first surface 33 of the hook of the connecting device 2 and the second surface 34 of the hook of the connecting device 2. This has also been described with regard to embodiments of aspect 2.

As is illustrated in FIG. 6*b*, the edge 50 of the arm may be tilted or angled towards a rotational center, around which the decking board 3 may be rotated when tilted for taking up the decking board, compared to a tangent 70 of an imaginary circle 71 at the tip of the tongue 49 of the decking board 3. The center of the imaginary circle 71 is located at the rotational center 72 and has a radius or circumference at the holding surface 48 or the tip of the tongue 49. Hence, the edge 50 will not interfere with the tip of the tongue when the decking board 3 is tilted. For example, and as illustrated in FIG. 2*b*, the edge 50 facing towards the first holding member 30 may be tilted or angled an angle a3, which may be more than 180 degrees relative the second surface 34 of the connecting device 2, which may be configured to abut the tongue 49 formed in the side surface 60 of the first decking board 3. Hence this provides for avoiding jamming of the connecting device during take-up and replacement or re-installation of a decking board 3.

Figure 8C:
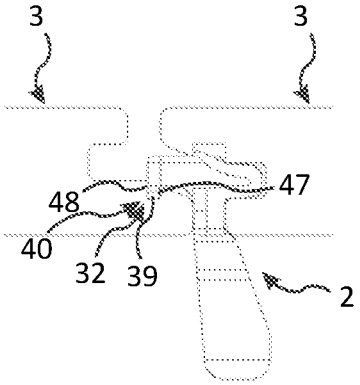
FIG. 8*c* is a side view of an embodiment of the connecting device locking boards and being locked to the support element.

The first holding surface 47 and the second holding surface 48 may be formed within the groove 40 of the first decking board 3 as shown in the embodiment in FIG. 8*c*. Opposing surfaces of the end portion of the hook of the connecting device 2 are configured to abut the first holding surface 47 and the second holding surface 48. A clearance space may be provided between the tip of the tongue and the connecting device 2. This also provides for avoidance of jamming of the connecting device 2 between the decking boards 3 during tilting of the second decking board 3.

Figure 8D:
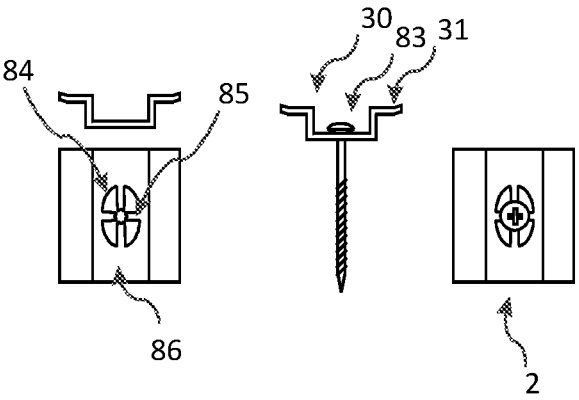
FIG. 8*d* is a side view of an embodiment of the connecting device without arms.

In some embodiments, such as shown in FIG. 8*d*, the connecting device 2 does not have any arms 7. Instead, the connecting device is attached to the support element 1 by a fastening device 83, such as a screw, that extends between the decking boards 3. The first 30 and second 31 holding members are configured to lock the first and second decking board 3, respectively, at least vertically relative the connecting device 2 and/or the support element 1. A top portion of the fastening device 83, such as a head of the screw, may be received in a seat 84 having one or a plurality of flexible arms 85. The seat 84 may extend inwardly from a peripheral member 86 that has a diameter, such as a hole diameter, that is larger than a diameter of the top portion of the fastening device 83. During tilting of the second decking board, the fastening device 83 does not have to be removed, e.g. the screw does not need to be unscrewed. Instead, the flexible arms 85 will deflect and the connecting device may be released when the peripheral member 86, which e.g. may be a ring-shaped member, passes over the top portion of the fastening device 83. When the connecting device is pushed down again when a decking board is replaced, the flexible arms 85 may deflect in the other direction and the top portion of the fastening device 83 may be received in the seat 84. This may avoid having any portion of the connecting device 2 between the tongue 49 of the first decking board 3 and the second decking board 3, whereby jamming of the connecting device 2 is avoided. This is further described with regard to aspect 5.

Aspect 4

FIGS. 6*a*-6*c* illustrate embodiments of methods for installing and/or replacing a decking board of a decking. The support element 1 is not illustrated in FIGS. 6*a*-6*c* for clarity reasons. In a first step, a first decking board 3*a* is tilted relative the other decking boards, 3*b*, 3*c*, 3*d*. The first decking board 3*a* is tilted relative its longitudinal direction. The first decking board 3*a* may be tilted preferably only along one of its edges to release the entire decking board and without the need to move any of the adjacent decking boards 3*b*, 3*c*.

In order to release the edge of the decking board not being tilted, the decking board may be displaced transversally after being tilted, wherein the entire decking board may be removed.

Hence, the method may comprise unlock a first lock, e.g. provided by a first connecting device, such as by tilting of a first decking board, i.e. moving in the vertical direction. Then, a second lock, such as provided by a second connecting device, may be unlocked. The second lock may be unlocked by tilting the decking board. Alternatively, or additionally, the second lock may be disengaged by moving the decking board to be unlocked in a horizontal direction, such as parallel and/or transverse to the decking. This may e.g. be useful for a connecting device having a "catch on hook" arrangement.

The connecting device 2 may be maintained in the first decking board 3*a* during the tilting, as is illustrated.

Then, when the first decking board 3*a* has been tilted, at least one decking board may be removed from the decking. In the embodiment of FIG. 6*a*, the first decking board 3*a* is tilted until the holding member 30 of the connecting device 30 disengages the second decking board. Alternatively, or additionally, the first decking board 3*a* is tilted until the holding member 30 is above the top surface 42 of the second decking board 3*b*. Alternatively or additionally, the connecting device 2 of the first decking board 3*a* is tilted until it is disengaged from the support element 1, which gives a clear feedback to the installer that sufficient tilting has been obtained. Tilting the first decking board 3*a* until the holding member 30 is above the top surface 42 of the second decking board 3*b* allows for more space for tilting the second decking board 3*b*, whereby the second decking board 3*b* is easier to remove. After tilting of the first decking board 3*a*, the second decking board 3*b* is removed. The second decking 3*b* board may be removed by tilting along its longitudinal direction, while the first decking board 3*a* is maintained in the decking. The locking members 8 of the connecting device 2, which is maintained in the first decking board 3*a* during tilting, may be locked to the locking member 5 of the support element 1 after the first decking board 3*a* has been tilted. Said differently, the connecting device 2 of the first decking board may be locked to the support element 1 after tilting of the first decking board 3*a* while the second decking board 3*b* is removed. The first decking board 3*a* may be tilted until protrusions 10 and/or recesses of the connecting device 2 still engage protrusions 9 and/or recesses of the supporting member 1. Hence, the first decking board 3*a* is held in position while the second decking board 3*b* is removed and possibly flipped around and reinstalled or is replaced.

In the embodiment of FIG. 6*b*, the first decking board 3*a* is tilted until the entire connecting device 2, which is maintained the first decking board 3*a*, is above the top surface 42 of the second decking board 3*b*. The first decking board 3*a* is then also removed. Hence, in the embodiment of FIG. 6*b*, the locking member 8 of the connecting device 2 maintained in the first decking board 3*a* is completely disengaged from the locking member 6 of the support element 1.

In the embodiment of FIG. 6*c*, the arms 7 of the connecting device 2 maintained in the first decking board 3*a* is not spaced apart from the tongue 49 of the second decking board 3*b* during tilting of the first decking board 3*a*, which is illustrated by a slight overlap between the connecting device 2 and the tongue 49. The shape of surfaces of the decking boards that abut the connecting device 2 in the installed position, such surfaces that provide the distance or gap between decking boards, may be complementary to the shape of abutting surface of the connecting device 2. Such surfaces of the board may provide a seat for a portion of the connecting device 2, such as illustrated in FIG. 6*a* at the right-most connecting device 2.

Furthermore, the connecting device 2, such as the edge 50 of the arm 7, may at least partly engage the tip of the tongue 49 during the tilting motion. Hence, rather than being spaced apart as has been described above, the connecting device 2 is flexible, and/or is mounted with sufficient clearance or play in the first decking board 3*a*, such that it bends or flexes during tilting of the first decking board 3*a*. The flexing may be provided by each or a combination of the flexibility of, e.g., the friction member 13, flexibility of the arms 7, the snap tab, the protrusion 37, the wings 18, the bridge connecting the arms 7, the bridge connecting the wings 18 and the arms 7. Hence, the connecting device 2 may be pretensioned in the first decking board 3*a* during the tilting. This may guide the connecting device 2 towards its accurate position, such as by the guiding surfaces described above, even if it is initially twisted or misaligned relative the support element.

In each of the embodiments of FIGS. 6*a*-6*c*, the holding member 31, such as a snap tab, holds and maintained the position of the connecting device 2 in the first decking board 3*a* while it is being tilted. However, tilting may be done with or without the holding member 31. Furthermore, the methods for taking up the decking board 3, 3*a*, 3*b* may be used together with each of the embodiments of each of aspect 1, aspect 2, aspect 3, aspect 5, aspect 6, aspect 8 and aspect 9, which will not be repeated with regard to aspect 4.

In order to fully remove a decking board after a first connecting device, such as the center left connecting device in FIG. 6*b*, has been unlocked, the decking board can be further tilted or moved until a second connecting device, such as the center right connecting device in FIG. 6*b*, is disengaged from the decking board. Hence, the decking board is fully disengaged.

Alternatively, such as for the embodiments illustrated in FIGS. 1*h*-1*j*, a tool may be inserted between the arms 7 to separate them enough to disengage from the support element 1. The tool may only be necessary for the second locking member but not the first locking member. A tool to separate the arms may be useful also when the arm or each arm has a single locking member. It is also useful in situations when a single locking position is provided between the connecting device 2 and the support element 1.

Furthermore, the decking board 3, 3*a*, 3*b*, 3*c* may have a lip that covers the gap and/or the connecting device from the top surface 42. In such situations, the connecting device may be unlocked by inserting a tool in the gap between the decking boards and engage the lip and move the decking board to be unlocked towards the top surface by bending of the tool. This may be useful to access the arms, such that they may be separated. This method may be useful also when the arms do not need to be separated.

In some embodiments, a tool may be used to displace at least one locking member providing vertical locking. This may be done by pushing the tool in the longitudinal direction of the decking board.

The embodiments of the methods described above may be used independently or in combination. The methods may be used with the embodiments of the connecting device 2, the decking boards 3, and the support elements 1 described herein. However, the embodiments of the methods may also be used independently from the embodiments of the connecting device 2, the decking boards 3, and the support elements 1 described herein.

Aspect 5

Aspect 5 relates to a multi-member connecting device 2, wherein a first member 2*a* is releasably connectable to a second member 2*b* as described e.g. in the embodiments in FIGS. 1*k-p* and 2*d-f* and in items 37-39.

FIGS. 1*k*-1*p* illustrate embodiments wherein the plurality of locking positions may be continuous, i.e. not positioned at predefined locations of the support element 1, such as described above with regard to aspect 1. The boards 3 may be decking boards 3. In addition to the features described above or to be used separately, the connecting device 2 may be a multi-member connecting device, which comprises at least a first member 2*a* and a second member 2*b*. The second member 2*b* may comprise the features described above with regard to the various aspects and embodiments of the connecting device, such as the legs or arms, the locking members, the protrusions and/or barbs or teeth, etc. and may be configured to lock the connecting device in the vertical direction relative the support element 1. The legs or arms may be pre-tensioned towards the support element, i.e. a distance between the teeth or barbs at each leg or arm is smaller than the width of the support element.

Moreover, the second member 2*b* may comprise the at least one first holding member and/or the at least one second holding member, and each may be configured to lock the first board transversely relative the connecting device and/or the second board vertically relative the connecting device. Embodiments of the first and second holding members are largely analogous to the embodiments described in this disclosure in relation to aspects 1-4, 7-9 and FIGS. 1*a-p*, 2*a-c*, 3, 4*a-d*, 5*a-g*, 6*a-c* and 7*a-b* whereby reference is made thereto.

Figure 1N:
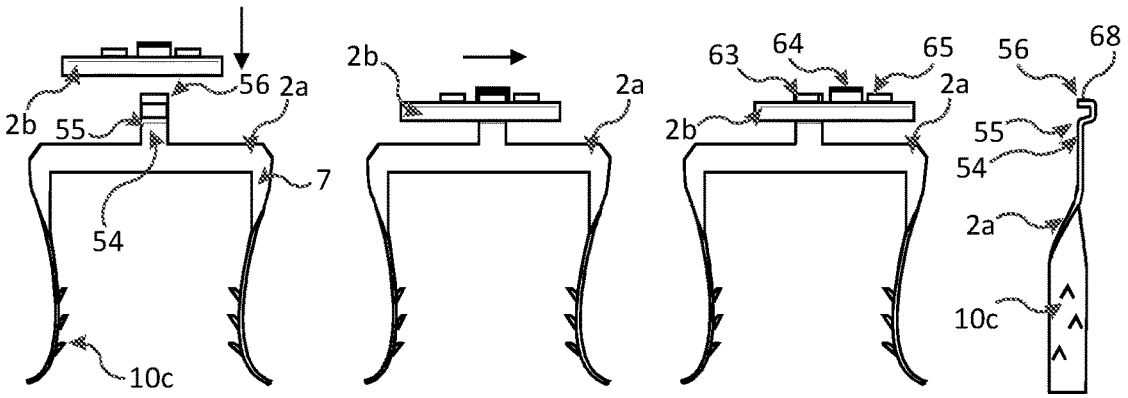
Figure 1O:
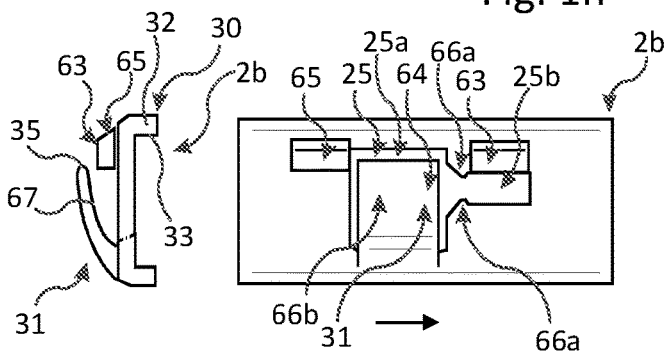
Figure 1P:
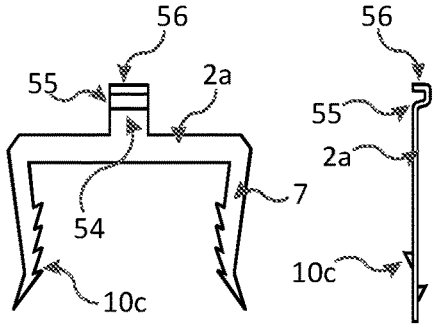
Figure 2D:
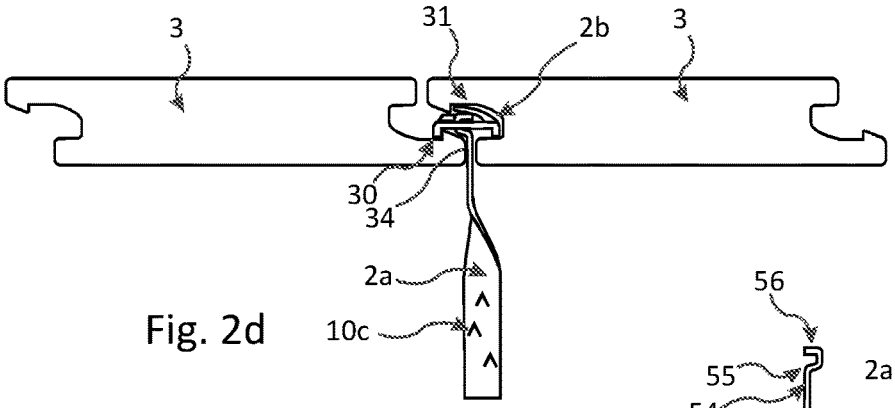
FIGS. 2*d*-*e* illustrate side views of embodiments of multi-member connecting devices locking boards and being locked to the support element.

A further embodiment of a multi-member connecting device is shown in FIGS. 1*n-o* and in a mounted state in FIG. 2*d*. The at least one first holding member 30 is configured to lock the first board 3 transversally and vertically relative the connecting device, and the at least one second holding member 31 is configured to lock the second board 3 transversely and vertically relative the connecting device. The first holding member 30 comprises a hook with a tip 32 in analogy with the embodiment in FIG. 2*a*, wherein reference is made thereto. In this embodiment, both the first member 2*a* and the second member 2*b* are part of the hook. The hook has a first surface 33 provided on the second member 2*b* and a second surface 34 provided on the first member 2*a*. The first holding member 30 engage a groove, such as the first groove 40 and/or the fourth groove 69 of a side surface 60 of the first board. The second holding member 31 may engage a groove, such as the second groove 43 and/or third groove 45, of a side surface 60 of the second board.

The second holding member 31 of the multi-member connecting device preferably comprises a snap tab in accordance with any of the embodiments described above. It may define a vertical position of the arms 7 with respect to the support element 1 when the first 2*a* and second 2*b* members are assembled.

The second holding member 31 is optional. In one embodiment (not shown), the multi-member is configured to lock the second board vertically relative the connecting device, and optionally in one transverse direction, e.g. by engagement between the first holding member 30 and the first holding surface 47, but not in two opposing transverse directions. Other features of the connecting device may be the same as those in FIGS. 1*n-o*.

In non-limiting examples, the first 2*a* and/or the second 2*b* member 2*a* may comprise a metal, such as stainless steel, plastic, such as PP, optionally reinforced with a glass-fibre material.

Other characteristics of the multi-member connecting device, such as embodiments of the arms 7, have been described under aspect 1 wherein reference is made to the above. Further additional or alternative features will be described next.

The first member 2*a* may comprise a post with an attachment portion 54, a neck portion 55, which is illustrated in phantom lines since it is covered by the second member 2*b* in FIGS. 1*k*-1*m*, and a head portion 56. The attachment portion 54 may be connected to or form part of the first member 2*a*, such that it may be fixed or fastened relative the support element 1 in at least one position, such as described above with regard to aspects 1-4.

The first member 2*a* is configured to releasably hold the second member 2*b*. For example, the second member 2*b* may comprise a slot 25 e.g. as illustrated in the embodiment in FIG. 1*o* seen in a top view. The slot 25 may have a first portion 25*a* sized to receive the head portion 56 and the neck portion 55 of the first member 2*a* there through. The slot may also have a second portion 25*b* sized to receive only the neck portion 55 therein. However, a diameter or width of the head portion is larger than the second portion 25*b* of the slot, such that the second member 2*b* is captured between the attachment portion 54 and the head portion 56. The diameter or width of the neck portion 55 is smaller than, or substantially equal to, a diameter or width of the second portion 25*b* of the slot. A length of the attachment portion 54 may substantially correspond to the thickness of the tongue 49. The slot 25 may e.g. be formed as a key-hole with a larger diameter portion and a smaller diameter portion, see e.g. the embodiment in FIG. 1*o*.

The attachment portion 54 may form a boss with a diameter or width that is larger than the diameter or width of the first portion 25*a* of the slot. Hence, the second member 2*b* may be supported by a top surface of the attachment portion 54.

Figure 2F:
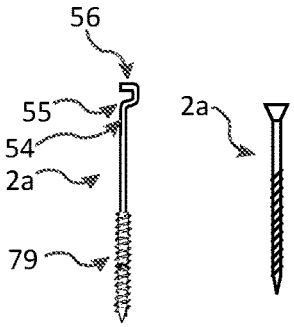
FIG. 2*f* is a side view of embodiments of a first member of the multi-member connecting device.
Figure 2E:
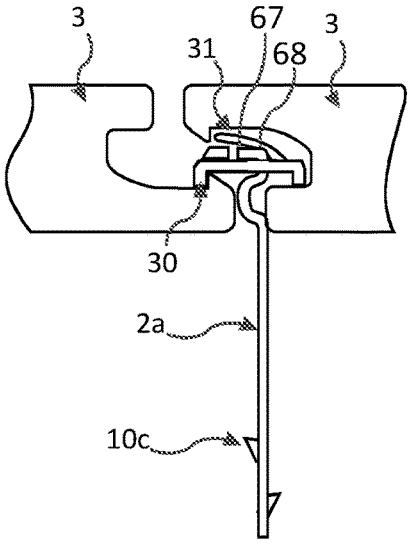

The second member 2*b* may form a plate that extends in the horizontal plane. Opposing edges of the plate may be received in grooves of the side surfaces 60, 61 of neighboring boards 3, such as in one or several of the grooves 40, 69 and 43, 45. The grooves may extend in the horizontal plane. Hence, the second member 2*b* does not need to lock the boards 3 in the transversal direction. However, in other embodiments, the second member 2*b* comprises a first holding member 30 and/or a second holding member 31, such as described above with regard to the embodiments of aspects 1-4, and the boards 3 may comprise the grooves as described above with regard to these aspects. In some embodiments, the first member 2*a* may be formed as a screw or nail with a post that forms the attachment portion 54 and may be configured to extend into the support element 1. A neck, such as a neck portion 55, may be provided between the post and a head, such as a head portion 56. The post and the head may have larger diameters or widths than the neck, such that only the neck is received in the second portion of the slot, such as described above. Embodiments of a first member 2*a* comprising a lower portion 79 formed as a screw are illustrated in FIG. 2*f*. The first member 2*a* in the rightmost subfigure may be a screw.

The second member 2*b* may be assembled to the first member 2*a* by inserting the head portion 56 and the neck portion 55 through the first portion of the slot 25, and then push the second member 2*b* in the horizontal direction such that the neck portion 55 is received at least partially, preferably completely, within the second portion 25*b* of the slot. One embodiment of this assemblage is shown in FIG. 1*n*. To disassemble the second member 2*b* from the first member 2*a*, the second member 2*b* is pushed in the horizontal direction such that the head portion 56 is aligned within the first portion 25*a* of the slot. Then, the board 3 may be tilted, such as described above, e.g. with regard to aspect 4.

The second member 2*b* may comprise an obstruction element 66*a* and/or 66*b* configured to keep the first member 2*a* positioned in the second portion 25*b* in an assembled state of the multi-member connecting device, see the embodiment in FIGS. 1*n-o*.

In a first embodiment, where the second holding member 31 is optional, the obstruction element 66*a* is formed in a tapering edge portion of the second portion 25*b* of the slot. The second member 2*b* may be assembled to, or disassembled from, the first member 2*a* by pushing the second member 2*b* relative to the first member 2*a* in the horizontal direction such that the second member 2*b* may be displaced past the obstruction element 66*a*.

In a second embodiment, the obstruction element 66*b* is formed out of the second holding member 31 which may be formed as a snap tab. During assemblage, the head portion 56 may push the second holding member 31 upwards and then the first member 2*a* may be horizontally displaced into the second portion 25*b* whereby the second holding member 31 may snap back into an original state in which, preferably, at least a portion of the underside 67 is provided under the upper side 68 of the first member 2*a* along the vertical direction of the first member 2*a*, the second holding member 31 and the first member 2*a* being horizontally offset. This is illustrated in the embodiment in FIG. 2*e* which shows an installed state of the boards 3 using the multi-member connecting device in FIG. 1*p*. A width of the first member 2*a* in the embodiment in FIGS. 1*n-o* may be larger in a lower portion, where the barbs or teeth 10*c* are provided, than in an upper portion. The width of the first member 2*a* in the embodiment in FIG. 1*p* may be substantially constant along its vertical direction.

The second member 2*b* may comprise at least one stabilizing element 63, 65, preferably arranged on a top surface of the second member. In FIGS. 1*n-o*, a stabilizing element 63 is arranged next to the second portion 25*b* and may be configured to counteract wobbling of the second member 2*b* with respect to the first member 2*a*. Moreover, a stabilizing element 65 is arranged next to the first portion 25*a*. The stabilizing element 63 and/or 65 may be configured to support a portion of the board 3 when the board is during loaded, cf. FIG. 2*d*.

Preferably, the arms 7 in the embodiment in FIGS. 1*n-o* are flexible. Moreover, the arms 7 in the embodiment in FIGS. 1*n-o* are preferably rigid.

Pushing the second member 2*b* may be done with a tool. The tool may e.g. be shaped as a fork with two pins that may be separated a distance such that the second member 2*b* may be received there between. The tool may be inserted in the gap between boards 3, and the second member 2*a* may be pushed in the horizontal direction.

In other embodiments, the second member 2*b* may be connected to the first member 2*a* by a snap-fit arrangement, such as described above with regard to FIGS. 3 and 4*a*. Such an internal locking arrangement may be arranged within the attachment portion 54 and with an arm formed integral with the second member 2*b*. Still an alternative is to have a snap-tab, such as described above. The tool may be configured to disengage any such snap-fit or snap-tab connection.

The embodiments providing a multi-member connecting device provide for a strong joint between the connecting device and the support element 1. Furthermore, a multi-member connecting device is useful in situations wherein at least a portion of the connecting device is non-releasable relative support element 1, such as when the protrusions are formed as teeth or barbs 10*c* that have a strong engagement to the support element 1. Therefore, the first member 2*a* may be permanently or non-releasably attached to the support element 1, whereas the second member 2*b* may be releasably attached to the first member 2*a*. Hence, embodiments wherein the connecting device 2 may be disassembled provide for flexibility.

It is emphasized that the embodiments of the multi-member connecting device presented in relation to FIGS. 1*k-p* and 2*d-f* are only exemplary and that the multi-member connecting device may be comprise other features of the present disclosure from any of the other aspects 1-4, 6-9. In particular, the multi-member connecting device may be configured to be locked in multiple vertical positions relative the second support element, e.g. as described in aspect 1, or in a single vertical position relative the second support element e.g. as described in FIGS. 7*a-b*.

Aspect 6

Figure 7B:
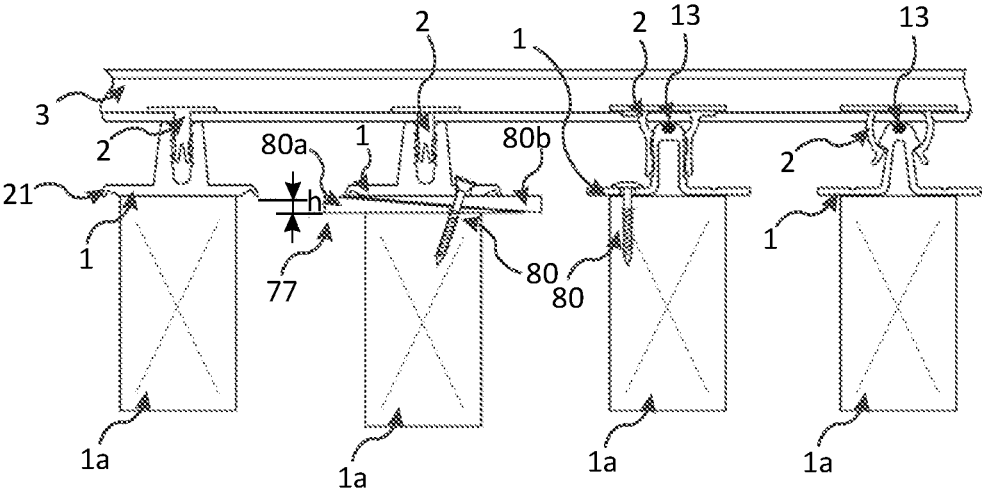

The embodiments of aspects 1 to 5 and aspects 7 to 9 may be used in independently or in combination in a support system for boards, such as decking boards. Such a system is illustrated in FIGS. 7*a*-7*b*, and may comprise a first support element 1*a* and a second support element 1.

The first support element 1*a* may be a discontinuous support element, such as comprising a plurality of pedestals or plinths, on which the second support element 1 may be arranged. Alternatively, or additionally, the first support element 1*a* may be the ground or a joist. The joist may in turn be supported by neighbouring pedestals or plinths, which are separated by a distance that is larger than a distance separating neighbouring joists. The joist may be made of a first material such as wood or WPC.

The second support element 1 may comprise the support element described above with regard to the embodiments of aspect 1 to aspect 5 or aspect 9. The second support element 1 may be made of a second material, such as aluminum or plastic.

The second material may be made with a production technique having higher production tolerances than the production technique used for the first material. Hence, the tolerances of the second support element 1 may be higher than the tolerances of the first support element 1*a*.

The second support element 1 does not need to be strong enough to carry the load applied to the boards 3 without an underlying support surface. However, even if the second support element 1 is designed to carry such load, it may be installed on the first support element 1*a*. The first support element may be configured to be to have a higher mechanical strength, i.e. to carry a higher load, than the second support element 1. The first support element 1*a* may not be possible to produce efficiently with sufficient tolerance to be connected to the connecting device 2.

The system may comprise a fastening element 80 for fastening the second support element 1 to the first support element 1*a*, or vice versa. The fastening element 80 may comprise a screw or bolt to be inserted though the recess 53 of the second support element 1 and that may engage the first support element 1*a*. Additionally or alternatively, the second support element 1 may comprise holes or recesses, through which the fastening element 80 engages the second support element 1.

In case one or a plurality of the first support elements 1*a* are not level, such as illustrated in FIG. 7*a* with distance h, connecting devices 2 that have multiple vertical positions relative the second support element 1 may be utilized. Such connecting devices 2 are described above, e.g. with regard to aspect 1, and illustrated by the three left-most connecting devices 2 in FIGS. 7*a*-7*b*.

Additionally, or alternatively, in case one or a plurality of the first support elements 1*a* are not level, such as illustrated in FIG. 7*a* with distance h, connecting devices 2 that have multiple vertical positions relative the second support element 1 may be utilized in combination with one or several connecting devices 2 that have a single vertical position relative the second support element 1. Such connecting devices 2 with a single vertical position is described above, e.g. with regard to aspect 2, and illustrated by the right-most connecting device 2 in FIGS. 7*a*-7*b*.

Additionally, or alternatively, in case one or a plurality of the first support elements 1*a* are not level, such as illustrated in FIG. 7*b* with distance h, a leveling or distance element 77 may be arranged between the second support element 1 and the first support element 1*a*. This embodiment is particularly useful when only connecting devices that have a single vertical position relative the second support element 1 are used. The leveling or distance element 77 may have an adjustable thickness or height, and may be arranged or configured with a thickness or height corresponding to the vertical distance h. Distance h is the gap between a top surface of the first support element 1*a* and a bottom surface of the second support element 1 when one first support element 1*a* is not level with at least one other first support element 1*a*. The material of the leveling or distance element may be solid, such as plastic or metal, or a hardening substance in liquid form such as putty or sealant.

In some embodiments, the leveling or distance element 77 comprises at least a first wedge member 80*a* and a second wedge member 80*b*. At least one of the wedge members 80*a*, 80*b* may comprise protrusions or transversal ridges that may engage cavities or transversal valleys of the opposing wedge member 80*a*, 80*b*. This may prevent slipping and make the system more robust. The wedge members 80*a*, 80*b* may be mutually displaced in the transversal direction to adjust the total vertical thickness or height of the leveling or distance member to correspond to distance h.

The fastening element 80 may extend through the leveling or distance element 77, such as through at least one, preferably both, of the wedge members 80*a*, 80*b*, such that the height of the second support element 1 is fixed relative the first support element 1*a* and the second support element 1 when exposed to environmental effects.

In some embodiments, a method to provide a plurality of support elements 1 with level top surfaces may be used. According to the method, a plurality of first support elements 1*a* may be positioned. The first support elements 1*a* may optionally be fixed to the underlying surface. Then, at least one second support element 1 is positioned on top of each of the second support elements 1*a*, such as longitudinally aligned with the first support element 1*a*. Longitudinal elements, such as decking boards 3, may be placed on top of the second support elements 1 and may span over several of the second support elements 1, e.g. in the direction they will later be attached or fixed to the second support elements 1. The longitudinal elements may be positioned at temporary positions with a fairly large gap in-between. Any of the second support elements 1 that is in contact with the longitudinal elements, such as exemplified with the first, third and fourth support element from the left in FIG. 7*b*, may then be attached or fixed to the underlying first support element 1*a*, such as described above. The height of any second support element 1 that is not in contact with the longitudinal elements, such as the second of the second support elements 1 from the left in FIG. 7*a*, may be brought into contact with the longitudinal element, and a leveling or distance element positioned between the first support element 1*a* and the second support element 1. Then, the second support element 1 may be fixed or attached to the first support element 1*a*, such as described above with a fastening element 80 through the leveling or distance element.

Before leveling any of the remaining loose second support elements 1, one or several will be brought into contact with the longitudinal elements which thereafter will be attached to the second support elements 1. For example, they may be temporarily or permanently attached using the connecting device 2. If the longitudinal element is not in the final and correct position, it may, after leveling and fastening of the first support element 1*a* and the second 1 support element to each other, be released from a temporary position, positioned in a final position, and attached or fixed using the connecting device 2. The same connecting device 2 may be used for temporarily and permanently attaching or fixing the longitudinal element to the second support element 1. As described above, the connecting device 2 may be snapped in position, and be releasably attached to the second support element 1. As illustrated in FIGS. 7*a* and 7*b*, connecting devices 2 having one or multiple releasable positions relative the second support element 1 may be utilized. Hence, the method may be used also without the step of positioning the leveling or distance element between the first support element 1*a* and the second support element 1. E.g. the first support 1*a* may be gravel that is leveled when all second supports 1 are temporarily fixed. The method embodiments above provide for a fast and very accurate leveling of the support elements.

Aspect 7

Figure 5G:
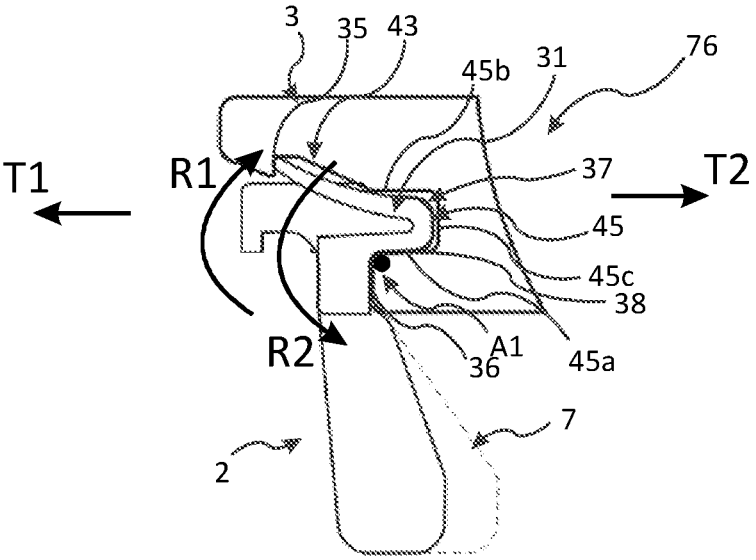
FIG. 5*g* illustrates a side view of an embodiment of a board unit.

FIG. 5*g* illustrates an embodiment of a single board unit 76 comprising a board 3 and a connecting device 2. Embodiments of the connecting device and the board, such as a decking board, may be the same as any of the embodiments described in relation to aspects 1-6 and 8-9, including items 1-59, and FIGS. 1*a*-*p*, 2*a*-*f*, 3, 4*a*-*d*, 5*a*-*g*, 6*a*-*c*, 7*a*-*b* and 8*b*-*c* of the present disclosure, whereby reference is made thereto. The connecting device may comprise a snap tab provided on a second holding member 31 as described above. In FIG. 5*g*, the connecting device is provided in the third groove 45 and is secured to the board in each of the directions T1, R1 and R2. T1 is a transversal direction of the board being directed outwards away from the board. Moreover, R1 and R2 are a first and a second angular direction around the axis A1, respectively. In FIG. 5*g*, the first and second angular directions are clockwise and counter-clockwise directions, respectively. Moreover, in this embodiment, the axis A1 extends along a longitudinal direction of the board and is provided in a transversely outermost point of the lower wall 45*a* of the third groove 45.

In this embodiment, the connecting device is also secured to the board in a transversal direction T2 of the board being directed inwards, and being opposite to the T1 direction.

By a "secured connecting device" is here meant that, when connected to the board, the connecting device is held in place during handling of the board unit 76, e.g. when it is rotated, displaced or tilted, and it does not fall out of the groove. Moreover, the board may change shapes, such as in the transversal direction, due to environmental effects without the connecting device disengaging or unlocking from the board. With reference to the discussion in relation to FIGS. 6*a*-6*c*, it is noted that during installation or removal of a board, the position of the connecting device 2 relative the board may be substantially maintained.

As shown in FIG. 5*g*, the board may comprise a second groove 43 which has been described elsewhere in this disclosure. An outer side wall of the second groove 43 prevents the second holding member 31, and hence the connecting device, from being displaced relative the board in the T1 direction past an outer transverse position. Moreover, the upper wall 45*b* of the third groove and/or the lower wall 45*a* and/or a wall of the second groove 43 prevents the connecting device from being rotated relative the board in the R1 direction past a first angular position. Finally, the lower wall 45*a* and/or the upper wall 45*b* prevents the connecting device from being rotated relative the board in the R2 direction past a second angular position. It is clear that the rotation in the R2 direction may be also be prevented by engagement between the first stop surface 35 and the outer side wall of the second groove 43.

A portion of the tongue 49*a* may prevent the second stop surface 36, and hence the connecting device, from being displaced relative the board in the T2 direction past an inner transverse position. Alternatively, or additionally, an inner wall 45*c* of the third groove may prevent the protrusion 37, and hence the connecting device, from being displaced relative the board in the T2 direction past an inner transverse position Preferably, the securing of the connecting device is screwless and does not comprise any additional separate fastening elements, such as screws, nails, adhesives, etc.

The connecting device may be disconnected from the board by displacing, e.g. sliding, the connecting device along the axis A1. It may also be disconnected from the board by compressing the snap tab, preferably along the longitudinal axis 17 of the at least one arm, and displacing it along T1.

Preferably, the connecting device is nondisplaceable in the transversal directions T1 and T2, inwardly and outwardly. For example, the connecting device may engage with the outer side wall of the second groove 43 and at least one of the second stop surface 36 and the inner wall 45*c*.

In some embodiments, however, the connecting device is secured but is displaceable in the transversal directions T1, T2 between an inner and an outer position, such as by a distance smaller than 2 mm.

Preferably, the connecting device is nondisplaceable in the first R1 and second R2 angular directions. For example, the second holding member 31 may engage with the upper wall 45*b* or with a wall of the second groove 43, and/or with the release surface 38. Optionally, the second holding member 31 may also engage with second stop surface 36 and/or the inner wall 45*c*.

In some embodiments, however, the connecting device is secured but is displaceable in the first R1 and second R2 angular directions between an inner and an outer position, preferably by an angle smaller than 25 degrees, such as 10 degrees.

There may be a gap or distance x1 between at least one upper part of the connecting device 2 and the overlapping decking board 3 as described in relation to FIG. 5*b*.

Aspect 8

Aspect 8 provides embodiments of a connecting system for boards 3, wherein the connecting device 2 pretensions at least one board towards the support element 1. Embodiments of aspect 8 have been described at least in aspect 1 and aspect 5 and in items 54-56, whereby reference is made to those parts of the disclosure.

Aspect 9

Aspect 9 provides embodiments of a decking system, wherein connecting devices 2 and support elements 1 are configured so that a plurality of boards are displaceable, preferably commonly displaceable as a single unit, along a longitudinal direction of the support elements 1. Embodiments of aspect 9 have been described at least in aspect 1 and 2 and in items 57-59, whereby reference is made to those parts of the disclosure.

Additional General Aspects

By decking board 3 or deck board is meant a board, panel, tile or plank or similarly that is configured to be provided on the support element 1. Throughout the disclosure, the shorthand notation "board" may have been used. The board may be installed indoors and/or outdoors. The board may comprise at least one of softwood, hardwood, a plastic material, such as PVC, PP/HDPP, PE/HDPP, wood fibres, bamboo fibres, stranded bamboo, or metal(s), such as aluminum or aluminum alloys. The board may comprise a mix of one or several of these materials. In a first example, the board is made of softwood, such as cedar, larch, fir or pine, all of which may be pressure treated. In a second example, the board is composite lumber or a Wood-Plastic Composite (WPC) decking board, comprising wood fibres or wood flour and plastics, preferably a thermoplastic, and optionally a filler and/or a binding agent. Similarly, the board may be a composite bamboo decking board, comprising bamboo fibres and plastics, preferably a thermoplastic, and optionally a filler and/or a binding agent. The board may comprise a protective layer for protecting the board against one or several of wear, moist, heat, sunlight, etc. A set of boards may comprise further boards, such as a third decking board, a fourth decking board, etc. In particular, there may be a plurality of decking boards. The boards in the set of boards preferably have one or several essentially identical characteristics, such as shape, material, weight, dimensions, colours, designs, protective layers, etc. The boards may be substantially identical. However, it is conceivable that some boards in the set of boards have different characteristics, such as different designs, e.g. comparing one top surface to the other even on two opposing sides on one board.

The connecting device 2 is a separate connecting device and preferably mounted to the boards during their installation. Preferably, there are a plurality of connecting devices in a system according to any aspect of the disclosure, arranged along the longitudinal direction of each support element 1. The connecting device 2 may be a clip, a clamp, a clasp, a catch, a hook, a spring clip, etc. The connecting device may comprise a metal, such as stainless steel alloys such as spring stainless steel alloys or aluminum, an alloy, such as an aluminum alloy, e.g. a 6060 aluminum alloy, such as 6060-T6, or a plastic, such as thermoplastic, e.g. polypropylene (PP), polyamide (PA), acrylonitrile butadiene styrene (ABS) or acrylonitrile styrene acrylate (ASA), or a combination of any of these materials. The connecting device 2, e.g. comprising thermoplastic, may comprise a glass-fibre material for reinforcement, preferably long glass fibre diameter 15-24 μm up to 50 weight percent. The connecting device 2 may comprise a plastic or a metal, e.g. aluminum, that may be injection moulded, extruded, or digitally printed.

Preferably, there are a plurality of support elements, such as arranged in parallel, or essentially in parallel, in a system according to any aspect of the disclosure. A longitudinal direction of the boards preferably is arranged perpendicularly to a longitudinal direction of the support elements. The support element 1 may be metallic or plastic. A plastic support element may be made by the same materials as exemplified for the connecting device. A metallic support element may e.g. be made of aluminum, such as extruded aluminum. The support element 1 may comprise a metal, such as stainless steel, galvanized steel or aluminum, an alloy, such as an aluminum alloy, e.g. a 6060 aluminum alloy, such as 6060-T6, or a plastic, such as thermoplastic, e.g. polypropylene, polyamide (PA), acrylonitrile butadiene styrene (ABS) or acrylonitrile styrene acrylate (ASA), or a combination of any of these materials.

It should also be appreciated that features disclosed in the foregoing description, and/or in the foregoing drawings and/or following claims both separately and in any combination thereof, be material for realizing the present invention in diverse forms thereof. When used in the following claims, the terms "comprise", "include", "have" and their conjugates mean, "including but not limited to".

The present invention has been described above with reference to specific embodiments. However, other embodiments than the above described are equally possible within the scope of the invention. In particular, any of the aspects 2-9 may be combined with any of the embodiments of the connecting device and the support element of the present disclosure, such as a connecting device having multiple locking positions relative the support element, such as in a vertical direction, as in the aspect 1. Alternatively, however, any of the aspects 2-9 may be combined with any embodiment herein wherein the connecting device has a single locking position relative the support element, such as in the embodiment illustrated by the right-most connecting device 2 in FIGS. 7*a*-7*b*. Furthermore, installed decking boards according to any aspect 1-8 may be configured to be commonly displaced in as a single unit according to aspect 9 and items 57-59. Also, it is stressed that the embodiment of the cladding system described in FIG. 8*a* may be combined with embodiments of any of the aspects 1-8, including the embodiments in items 1-56. Moreover, different method steps than those described above may be provided within the scope of the invention. The different features and steps of the invention may be combined in other combinations than those described.

Embodiments

Further aspects of the inventive concept are provided below. Embodiments of these aspects are largely analogous to the embodiments as described and exemplified above for aspect 1, aspect 2, aspect 3, aspect 4, aspect 5, aspect 6, aspect 7, aspect 8 and aspect 9, wherein reference is made to the above for a detailed description.

Item 1. A connecting device for a board system, the connecting device having a vertical direction and a transversal direction perpendicular to the vertical direction, and comprising a locking member (8) for vertically locking the connecting device (2) relative a support element (1);

at least one first holding member (30) for locking a first board (3) transversally relative the connecting device; and at least one second holding member (31) for locking a second board (3) vertically relative the connecting device.

Item 2. The connecting device according to item 1, wherein the first holding member (30) is configured to lock the first board vertically relative the connecting device; and the second holding member is configured to lock the second board transversally relative the connecting device.

Item 3. The connecting device according to item 1 or 2, wherein the connecting device (2) is configured to:

allow the first board and the second board to move in the transversal direction due to environmental effects without the connecting device disengaging or unlocking from the boards.

Item 4. The connecting device according to any of items 1-3, wherein the connecting device (2) is configured to:

be slightly flexible, such that a distance between the first holding member (30) and the second holding member (31) extends or follows movement of at least one of the first board and the second board in the transversal direction when exposed to a compression force or separation force in at least one transversal direction.

Item 5. The connecting device according to any of items 1-4, wherein the connecting device (2) is configured to:

to have sufficient tolerance, clearance or play relative the first board and/or the second board such that movement of the first board and/or the second board in the transversal direction is allowed.

Item 6. The connecting device according to any of items 1-5, wherein the connecting device (2) is configured to have substantially no clearance or less clearance than the maximum movement of the first board and/or the second board in the transversal direction, and to be substantially rigid and maintain its shape in response to movement of the boards whereby the connecting device is sufficiently strong such that the installed boards may move in the transversal direction as a unit, such as an entire decking.

Item 7. The connecting device according to any of items 1-6, wherein the first holding member comprises a hook with a tip (32) pointing towards the locking member, the hook having a first surface (33) and a second surface (34) extending at least partially in the vertical direction;

the second holding member comprises a first stop surface (35) and a second stop surface (36), wherein the first stop surface and the second stop surface face at least partially in transversely opposing directions; and the tip of the hook is transversally spaced apart from the locking member.

Item 8. The connecting device according to any of items 7, wherein the second holding member comprises at least one protrusion (37) with a release surface (38) extending in the transversal direction and facing towards the locking member (8).

Item 9. The connecting device according to item 8, wherein the protrusion (37) extends from a wing (18) of the connecting device (2).

Item 10. The connecting device according to any of items 1-9, wherein the second holding member (31) is a snap tab with a tip forming the first stop surface (35) and pointing in a direction towards the first holding member (30).

Item 11. The connecting device according to any of items 1-10, wherein the second holding member (31) comprises a release surface (38) extending in the transversal direction and facing towards the locking member (8).

Item 12. The connecting device according to any of items 1-9, wherein the second holding member (31) is generally U-shaped with one leg forming a snap tab with a tip forming the first stop surface (35) and pointing in a direction towards the first holding member (30) and with the other leg forming a release surface (38) extending in the transversal direction and facing towards the locking member (6).

Item 13. The connecting device according to any of items 1-12, comprising a first wing (18) and a second wing (18) between which a pressure plate (16) is arranged, wherein at least one of said wings at least partially forms said second holding member (31).

Item 14. The connecting device according to any of items 1-13, comprising a pressure plate (16) generally arranged perpendicularly to the locking member (8), and having a flange (39) extending from the pressure plate and forming a free end portion of said hook.

Item 15. The connecting device according to any of items 1-14, wherein a pressure plate (16) comprises a top surface extending at least partially over a longitudinal axis (17) of the locking member (8).

Item 16. A connecting device independently, or according to any of items 1-15, 19-36, and/or claims 1-26, wherein a locking member (8) for vertically locking the connecting device (2) relative a support element (1) comprises a first locking member and a second locking member providing different locking force.

Item 17. The connecting device according to item 16, wherein the first locking member has at least one first protrusion with a first height and the second locking member has at least one second protrusion with a second height, wherein the first height is lower than the second height.

Item 18. The connecting device according to item 16 or 17, wherein an angle of the first locking member, such as proximal flank of a first protrusion thereof, relative a longitudinal axis of the connecting device is negative, and wherein an angle of the second locking member, such as proximal flank of a second protrusion thereof, relative a longitudinal axis of the connecting device is positive.

Item 19. A system for installing boards, comprising a connecting device (2) according to item 1, a first board (3) configured to extend in a longitudinal direction and a transversal direction, and a second board (3) configured to extend in the longitudinal direction and the transversal direction, wherein the first board comprises a first groove (40) extending in the longitudinal direction of the first board and being configured to at least partially receive the first holding member;

the second board comprises a second groove (43) extending in the longitudinal direction and being configured to receive at least a portion of the second holding member (31).

Item 20. The system according to item 19, wherein the second holding member (31) of the connecting device is a snap tab with a tip forming a first stop surface and pointing in a direction towards the first holding member (30) of the connecting device, wherein the tip of the snap tab is configured to be received at least partially into the second groove (43), which comprises an opening (44) facing towards a bottom side of the second board.

Item 21. The system according to item 19 or 20, wherein the second board comprises a third groove (45) extending in the longitudinal direction and having an opening (46) facing in the transversal direction, the second holding member (31) of the connecting device comprises a release surface (38), which extends in the transversal direction and faces towards the locking member (6), and wherein the release surface is configured to abut a portion of the third groove (45), which faces towards a top surface (42) of the second board.

Item 22. The system according to any of items 19-21 wherein the first board comprises a first holding surface (47) and a second holding surface (48), which extend at least partially in the vertical direction, wherein the first surface (33) of a hook of the connecting device is configured to abut the first holding surface, and the second surface (34) of the hook of the connecting device is configured to abut the second holding surface.

Item 23. The system according to item 22, wherein the first holding surface (47) is formed within the first groove (40) and the second holding surface (48) is formed by a tip of a tongue (49) of the first board, and wherein said tongue is configured to be received at least partially between the first surface (33) of the hook of the connecting device and the second surface (34) of the hook of the connecting device.

Item 24. The system according to item 19, wherein the first holding surface (47) and the second holding surface (48) are formed within the first groove (40), and wherein opposing surfaces of an end portion of the hook of the connecting device are configured to abut the first holding surface and the second holding surface.

Item 25. The system according to any of items 19-24, wherein the first board comprises a tongue (49) with a tip, and the locking member (8) of the connecting device comprises at least one arm (7) configured to extend in the vertical direction between the tongue of the first board and the second board, wherein an edge (50) of said arm, which faces in a direction towards the first board, such as the tongue of the first board, is at least partially offset in the transversal direction from the tip of the tongue.

Item 26. The system according to item 25, wherein the edge (50) of the arm, which is configured to face towards the tongue, is angled more than 180 degrees relative a second surface (34), such as a stop surface, of the connecting device, which is configured to abut the tongue of the first board.

Item 27. A system for installing boards, comprising, a first board (3) configured to extend in a longitudinal direction and a transversal direction and having a top surface (42), a bottom surface (51) and at least one side surface (60) extending therebetween, a second board configured to extend in the longitudinal direction and the transversal direction and having a top surface (42), a bottom surface (51) and at least one side surface (61) extending therebetween, and a connecting device (2), wherein the second board (3) is tiltable from a locked position, wherein it is transversally locked to the first board, to an unlocked position, wherein it is transversally unlocked from the first board (3), the position of the connecting device (2) relative the second board being substantially maintained, at least partially during tilting of the second board, between the locked position and the unlocked position.

Item 28. A system for installing boards, comprising, a first board (3) configured to extend in a longitudinal direction and a transversal direction and having a top surface (42), a bottom surface (51) and at least one side surface (60) extending therebetween, a second board configured to extend in the longitudinal direction and the transversal direction and having a top surface (42), a bottom surface (51) and at least one side surface (61) extending therebetween, and a connecting device (2), wherein the second board (3) is tiltable from an unlocked position, wherein it is transversally unlocked from the first board, to a locked position, wherein it is transversally locked to the first board (3), the position of the connecting device (2) relative the second board being substantially maintained, at least partially during tilting of the second board, between the unlocked position and the locked position.

Item 29. The system according to item 27 or 28, wherein the connecting device (2) is configured to hold the first board and the second board in at least one transversal direction, and comprising a locking member (8) for locking the first board and the second board in a vertical direction relative a support element (1).

Item 30. The system according to any of items 27-29, wherein the locking member comprises at least one arm (7), a portion of the connecting device is configured to be received within the side surface of the second board such that an edge (50) of the arm (7) faces in a direction towards the side surface of the first board, the arm is configured to extend between the side surface of the first board and the side surface of the second board and beyond the bottom sides of the first board and the second board, and the edge of the arm is configured to be at least partially offset in the transversal direction from the side surface of the first board such that the edge (50) of the arm is spaced apart from or at least partly engages the side surface (60) of the first board while second board is tilted from the locked position to the unlocked position.

Item 31. The system according to any of items 27-30, wherein the second board in its side surface (61) comprises a groove (45) extending in the longitudinal direction and having an opening (46) facing in the transversal direction, a holding member (31) of the connecting device comprises a release surface (38), which extends in the transversal direction and faces towards the locking member (6), wherein the release surface is configured to abut a portion of the groove (45), which portion faces towards the top surface (42) of the second board.

Item 32. The system according to any of items 27-31, wherein the first board in its side surface (60) comprises a first holding surface (47) and a second holding surface (48), which extend at least partially in the vertical direction, wherein a first surface (33) of a hook of the connecting device is configured to abut the first holding surface, and a second surface (34) of the hook of the connecting device is configured to abut the second holding surface.

Item 33. The system according to item 32, wherein the first holding surface (47) is formed within a groove (40) of the side surface of the first board, and the second holding surface (48) is formed by a tip of a tongue (49) of the first board, and wherein said tongue is configured to be received at least partially between the first surface (33) of the hook of the connecting device and the second surface (34) of the hook of the connecting device.

Item 34. The system according to any of items 27-33, wherein the edge (50) of the arm is angled more than 180 degrees relative a second surface (34) of the connecting device, the second being configured to abut a tongue (49), which is formed in the side surface of the first board, in the locked position.

Item 35. The system according to item 32, wherein the first holding surface (47) and the second holding surface (48) are formed within a groove (40) of the first board, and wherein opposing surfaces of an end portion of the hook of the connecting device are configured to abut the first holding surface and the second holding surface.

Item 36. The system according to item 35, wherein a clearance is provided between the tip of the tongue and the connecting device.

Item 37. A connecting device independently, or according to any of items 1-36, and/or claims 1-26, wherein the connecting device (2) comprises a first member (2*a*) and a second member (2*b*), wherein the second member is releasably connectable to the first member.

Item 38. The connecting device according to item 37, wherein the first member (2*a*) is non-releasably connectable to a support element (1).

Item 39. The connecting device according to item 37 or 38, wherein the first member (2*a*) comprises a head portion (56) and a neck portion (55), and the second member (2*b*) comprises a slot with a first portion and a second portion, and wherein the first portion is configured to receive the head portion and the neck portion therein, and the second portion of the slot is configured to receive only the neck portion therein, and wherein a diameter of the head portion is larger than a diameter of the second portion of the slot.

Item 40. A system comprising a first support element (1*a*), a second support element (1), and a connecting device (2), wherein the first support element is configured to support the second support element, the second support element is configured to support at least one board, and the connecting device is releasably connectable to the second support element.

Item 41. The system of item 40, further comprising a leveling or distance element (77) configured to be positioned between the first support element (1*a*) and the second support element (1).

Item 42. The system of item 40 or 41, comprising the connecting device (2) of any of items 1-39, and/or any of claims 1-26.

Item 43. A system comprising a connecting device (2) and at least one board (3) having a tongue, wherein the connecting device comprises at least one upper part sized and configured to be spaced apart, at one or several positions, from the tongue, such as from an opposing portion of the tongue, when the connecting device is mounted relative the board and when the tongue of the board is unloaded in the vertical direction.

Item 44. The system according to item 42, wherein the at least one upper part is a pressure plate 16 of the connecting device 2.

Item 45. The system of item 43 or 44, comprising the connecting device (2) of any of items 1-42, and/or any of claims 1-26.

Item 46. A board unit, comprising:

a board (3) comprising a groove, such as a third groove (45), and a connecting device (2) configured to releasably fasten the board to a support element (1), wherein the connecting device is configured to be provided in the groove and to be secured to the board in each of:

a transversal direction (T1) of the board being directed outwards away from the board, a first angular direction (R1) around an axis (A1) which is provided along a longitudinal direction of the board and which is provided in a transversely outer portion, preferably an outermost point, of a lower wall (45*a*) of the groove, and a second angular direction (R2) around said axis being opposite to the first angular direction.

Item 47. The board unit of item 46, wherein the connecting device is configured to be provided in said groove by means of snapping, preferably by means of a snap tab provided on a second holding member (31) of the connecting device.

Item 48. The board unit of item 46 or 47, wherein the connecting device is configured to be disconnected from the board by displacing, e.g. sliding, the connecting device in said longitudinal direction.

Item 49. The board unit according to any of items 46-48, wherein the secured connecting device is nondisplaceable in the transversal direction.

Item 50. The board unit according to any of items 46-49, wherein the secured connecting device is nondisplaceable in the first and second angular direction.

Item 51. The board unit according to any of items 46-48 and 50, wherein the secured connecting device is displaceable in the transversal direction between an inner position and an outer position.

Item 52. The board unit according to any of items 46-49 and 51, wherein the secured connecting device is displaceable in the first and second angular directions between a first and a second angular position.

Item 53. The board unit according to any of items 46-52, comprising the connecting device (2) of any of items 1-42, and/or any of claims 1-26.

Item 54. A system, comprising at least one board (3) comprising a groove, such as a third groove (45) or a fourth groove (69), a support element (1) for supporting the at least one board; and a connecting device (2) configured to fasten, preferably releasably fasten, the at least one board (3) to the support element, wherein, in an installed state of the system, the connecting device pretensions the at least one board towards the support element, preferably in a vertical direction, and wherein, optionally, said at least one board is displaceble in the installed state, preferably commonly displaceable as a single unit, along a longitudinal direction of the support element.

Item 55. The system of item 54, wherein a vertical distance between a portion of the connecting device (2), such as a first (30) or a second (31) holding member, configured to engage with the groove in the installed state, preferably a lower wall of the groove, and a protrusion (8) of the connecting device, preferably an uppermost protrusion of a set comprising at least one protrusion, is smaller than a vertical distance between a portion of the groove configured to engage with the connecting device, preferably provided in a lower wall of the groove, such as in a transversely outermost portion of the lower wall, and a portion of the support element configured to engage with the connecting device, preferably a protrusion (6) of the support element, such as an uppermost protrusion of a set comprising at least one protrusion.

Item 56. The system of item 54 or 55, wherein at least one of a friction member (13), said portion of the connecting device (2) configured to engage with the groove in the installed state, at least one arm (7) of the connecting device, and at least one protrusion (8) of the connecting device is flexible, and preferably contributes to said pretensioning.

Item 57. A decking system comprising a plurality of connecting devices (2), a plurality of decking boards (3), each board being configured to extend in a longitudinal direction and a transversal direction, and a plurality of support elements (1) provided in parallel, or essentially in parallel, along a longitudinal direction of the support elements, wherein each connecting device is configured to fasten, such as releasably fastened, at least one board in a pair of adjacent boards to a corresponding support element, such that the longitudinal directions of the pair of adjacent boards each are provided perpendicularly, or essentially perpendicularly, to a longitudinal direction of the corresponding support element, and wherein the connecting devices and support elements are configured so that the plurality of boards are displaceable, preferably commonly displaceable as a single unit, relative the support element in said longitudinal direction of the support element when fastened to the plurality of support elements, wherein the boards are interconnected to each other in a longitudinal direction of the support elements by the connecting devices.

Item 58. The decking system of item 57, wherein the boards are displaceable while the connecting devices lock them in the vertical direction and/or hold them in the transversal direction.

Item 59. The decking system of item 57 or 58, wherein each connecting device (2), each board (3), and each support element (1) are provided according to the connecting device (2), the board, and the support element of any of items 1-42, and/or any of claims 1-26.

The invention claimed is:

1. A connecting system for boards, comprising a support element for supporting at least one board; and a connecting device configured to releasably fasten the at least one board to the support element, wherein the support element comprises at least one lateral surface, and at least one locking member arranged on said lateral surface;

the connecting device comprises at least one arm with a locking member configured for engagement with the locking member of the support element; and at least one of the locking member of the support element and the locking member of the connecting device comprises a plurality of protrusions forming a plurality of locking positions of the connecting device relative the support element.

2. The connecting system according to claim 1, wherein each of the locking member of the support element and the locking member of the connecting device comprises a plurality of protrusions.

3. The connecting system according to claim 1, wherein the support element comprises two lateral surfaces, each lateral surface comprising one locking member, and wherein the connecting device comprises two locking members, each locking member of the connecting device arranged to face one of the locking members of the support element, and at least one of the locking members of the support element and the locking members of the connecting device comprises a plurality of protrusions.

4. The connecting system according to claim 3, wherein the connecting device comprises two opposing arms, each arm comprising the locking member facing the locking member of the other arm, and the locking members of the support element are arranged on said lateral surfaces and are facing in generally opposing directions.

5. The connecting system according to claim 4, wherein a distance between the locking members of said arms is shorter than a distance between the locking members of said lateral surfaces, whereby said arms are pre-tensioned towards said support element when the connecting device is positioned in locking engagement with said support element.

6. The connecting system according to claim 1, wherein a top surface of the support element comprises at least one retention element for holding a friction member configured to abut at least one board when the connecting device is positioned in locking engagement with said support element.

7. The connecting system according to claim 6, wherein the at least one retention element is a mechanical retention element, which comprises a recess having an opening at said top surface.

8. The connecting system according to claim 1, wherein the support element is slanted between a top surface, which is arranged generally transverse to the lateral surface, and the lateral surfaces of said support element.

9. The connecting system according to claim 1, wherein the connecting device comprises a first wing and a second wing between which a pressure plate of the connecting device is arranged.

10. The connecting system according to claim 9, wherein the pressure plate is substantially centered between at least one of said first wing and said second wing.

11. The connecting system according to claim 9, wherein each wing has a surface generally facing in a direction opposite to the top surface of the pressure plate.

12. The connecting system according to claim 1, comprising a pressure plate generally arranged perpendicularly to said at least one arm and having a top surface extending at least partially over a longitudinal axis of said at least one arm.

13. The connecting system according to claim 1, wherein the support element comprises at least one bottom surface generally facing an opposite direction of the top surface of the support element, wherein the bottom surface comprises a drip edge and a support surface, wherein a tip of the drip edge is positioned in substantially a same plane as the support surface or vertically closer to a top surface of the support element than the support surface, and wherein, optionally, a groove is provided in the bottom surface between the drip edge and the support surface.

14. The connecting system according to claim 1, wherein the connecting device further comprises a first holding member for locking a board transversally relative the connecting device.

15. The connecting system according to claim 14, wherein the connecting device further comprises a second holding member for locking a board vertically relative the connecting device, the second holding member comprising a protrusion with a release surface that extends in the transversal direction of the connecting device and faces towards the locking member of the connecting device.

16. A support element for a board connecting system, the support element being configured to support at least one board, and comprising:

first and second lateral surfaces, and a locking member arranged on said first lateral surface, wherein the locking member comprises a plurality of protrusions forming a corresponding plurality of locking positions for a connecting device of the board connecting system, the first and second lateral surfaces being connected to one another by a bridging structure at an upper end of the support element; and first and second base members extending in generally horizontal opposite directions, respectively from lower ends of the first and second lateral surfaces at a bottom end of the support element, wherein outermost ends of the first and second base members are free from vertical overlap by the first lateral surface, the second lateral surface, and the bridging structure.

17. The support element according to claim 16, wherein the locking member is a first locking member and the plurality of protrusions is a first plurality of protrusions, wherein the second lateral surface comprises a second locking member, and wherein the second locking member comprises a second plurality of protrusions.

18. The support element according to claim 17, wherein the first and second locking members are facing in generally opposing directions.

19. The support element according to claim 16, wherein a top surface comprises at least one retention element for holding a friction member.

20. The support element according to claim 19, wherein the at least one retention element is a mechanical retention element, which comprises a recess having an opening at said top surface.

21. The support element according to claim 16, wherein the support element is slanted between respective top surfaces and the first and second lateral surfaces of said support element.

22. The support element according to claim 16, wherein the support element comprises at least one bottom surface generally facing an opposite direction of a top surface, which is arranged generally transverse to the first lateral surface, wherein the bottom surface comprises a drip edge and a support surface, wherein a tip of the drip edge is positioned in a same plane as the support surface or vertically closer to the top surface than the support surface.

23. A connecting device for releasably fastening at least one board to a support element of a board system, comprising:

a first arm with a first locking member configured for engagement with a first engagement surface of the support element, wherein the first locking member comprises a first plurality of protrusions forming a plurality of locking positions of the connecting device relative the support element; and a second arm, opposing the first arm, with a second locking member configured for engagement with a second engagement surface of the support element, wherein the first and second locking members face each other.

24. The connecting device according to claim 23, wherein the second locking member comprises a second plurality of protrusions.

25. The connecting device according to claim 24, wherein at least one of the first plurality of protrusions is arranged at a first vertical position, and wherein at least one of the second plurality of protrusions is arranged at a second vertical position, wherein the first vertical position is different from the second vertical position, and wherein the locking member is formed by said at least one of the first plurality of protrusions and said at least one of the second plurality of protrusions.

26. The connecting device according to claim 23, comprising a pressure plate generally arranged perpendicularly to said first and second arms and having a top surface extending at least partially over a longitudinal axis of said first and second arms.

27. The connecting device according to claim 26, comprising a first and a second wing between which the pressure plate is arranged.

28. The connecting device according to claim 23, wherein said protrusions form teeth for engagement with said at least one engagement surface of the support element.

29. The connecting device according to claim 23, further comprising a first holding member for locking a board transversally relative the connecting device.

30. The connecting device according to claim 29, further comprising a second holding member for locking a board vertically relative the connecting device, the second holding member comprising a protrusion with a release surface that extends in the transversal direction of the connecting device and faces towards the locking member of the connecting device.

* * * * *